US010135149B2

(12) United States Patent
Zhou

(10) Patent No.: US 10,135,149 B2
(45) Date of Patent: Nov. 20, 2018

(54) PHASED ARRAY FOR MILLIMETER-WAVE MOBILE HANDSETS AND OTHER DEVICES

(71) Applicant: Samsung Electronics Co., Ltd., Suwon-si, Gyeonggi-do (KR)

(72) Inventor: Hongyu Zhou, Richardson, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 471 days.

(21) Appl. No.: 14/176,941

(22) Filed: Feb. 10, 2014

(65) Prior Publication Data

US 2015/0035714 A1 Feb. 5, 2015

Related U.S. Application Data

(60) Provisional application No. 61/860,092, filed on Jul. 30, 2013.

(51) Int. Cl.
*H01Q 13/10* (2006.01)
*H01Q 3/26* (2006.01)
*H01Q 1/24* (2006.01)

(52) U.S. Cl.
CPC ..... *H01Q 13/106* (2013.01); *H01Q 3/26* (2013.01); *H01Q 1/243* (2013.01)

(58) Field of Classification Search
CPC ..... H01Q 1/243; H01Q 13/106; H01Q 3/26
USPC ..... 343/767, 772, 872, 898, 700 MS
See application file for complete search history.

(56) References Cited

U.S. PATENT DOCUMENTS

| | | | | |
|---|---|---|---|---|
| 6,380,825 | B1 | 4/2002 | Takenoshita et al. | |
| 7,808,439 | B2 | 10/2010 | Yang et al. | |
| 8,692,731 | B2 | 4/2014 | Lee et al. | |
| 2006/0066487 | A1* | 3/2006 | Park | H01Q 1/38 343/700 MS |
| 2010/0308668 | A1* | 12/2010 | Rofougaran | H01Q 1/2283 307/149 |
| 2011/0248891 | A1 | 10/2011 | Han et al. | |
| 2011/0309899 | A1* | 12/2011 | Leiba | H01P 3/121 333/208 |
| 2014/0240186 | A1 | 8/2014 | Zhou et al. | |

OTHER PUBLICATIONS

U.S. Office Action dated Dec. 4, 2015 in connection with U.S. Appl. No. 14/108,071; 16 pages.

* cited by examiner

*Primary Examiner* — Jessica Han
*Assistant Examiner* — Jae Kim

(57) ABSTRACT

An apparatus includes an antenna element. The antenna element includes a first portion of a multi-layer printed circuit board (PCB) and a cap covering at least part of the first portion of the multi-layer PCB. The multi-layer PCB includes multiple substrates, and the first portion of the multi-layer PCB includes a first slot through the multiple substrates. The cap includes a second slot and defines a space between the first portion of the multi-layer PCB and the cap. The cap and a conductive layer of the multi-layer PCB form a waveguide structure through which wireless signals radiate from the antenna element.

20 Claims, 23 Drawing Sheets

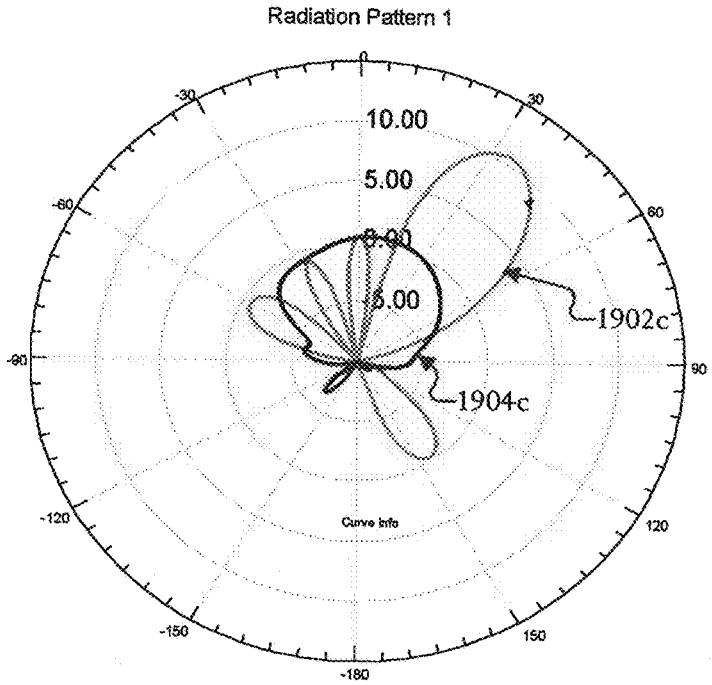
FIGURE 19E
FIGURE 19F
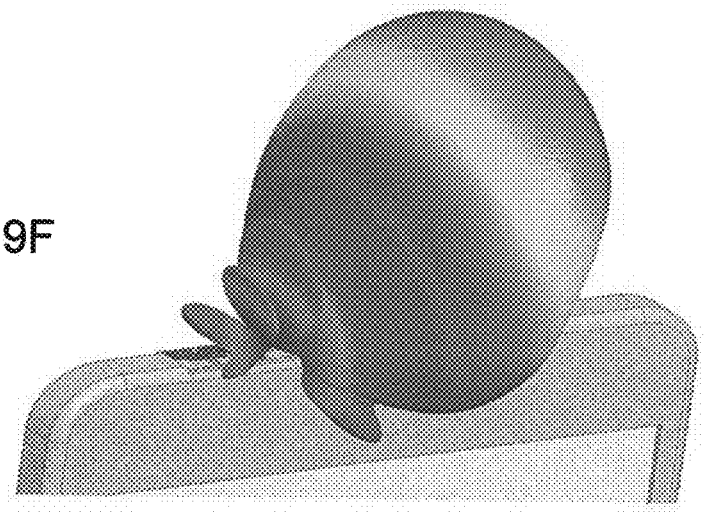

PHASED ARRAY FOR MILLIMETER-WAVE MOBILE HANDSETS AND OTHER DEVICES

CROSS-REFERENCE TO RELATED APPLICATION AND CLAIM OF PRIORITY

This application claims priority under 35 U.S.C. § 119(e) to U.S. Provisional Patent Application No. 61/860,092 filed on Jul. 30, 2013. The above-identified provisional patent application is hereby incorporated by reference in its entirety.

TECHNICAL FIELD

This disclosure relates generally to wireless communications. More specifically, this disclosure relates to a phased array for millimeter-wave (mmWave) mobile handsets and other devices.

BACKGROUND

For 5G millimeter-wave (mmWave) mobile handsets, a reduced number of antenna arrays is desirable due to space limitations. The number of antenna arrays could equal the minimal number needed to satisfy equivalent isotropically radiated power (EIRP) requirements and obtain adequate angular coverage.

Unfortunately, display screens and batteries in a handset impose serious difficulties for mmWave antenna array allocation and signal routing. Traditional handset antenna designs use meandered electrical small antennas (ESA) that are conformal to part of the handset's case, which in low frequencies are adequate to obtain omni-directional coverage due to strong multipath/scattering effects and much lower gain requirements.

In mmWave antenna designs, big scatters such as display screens and batteries represent ultra-large ground planes for any radiators. Added material losses due to the reduced wavelengths of mmWave antennas make antenna efficiency an important factor in the design of mmWave antennas. The reduced wavelengths also make RF signal transitions from a microstrip to other transmission lines prone to radiation and reflection. These factors can result in a very limited selection of antenna elements for use in mmWave antennas. For these reasons, many mmWave antennas are designed directly on a printed circuit board (PCB), in-package, or on an integrated circuit (IC).

Existing PCB-compatible mmWave antenna designs typically use printed-dipole/loop, Yagi-Uda, slot, patch, or Vivaldi antenna elements. Of these five candidates, three are inherently directional with narrow beamwidths and relatively high gains. Dipole and slot antenna elements could be omni-directional in free space, but printed mmWave dipole and slot antenna elements become directional in a complex environment such as a handset chassis due to strong substrate and ground plane effects. Printed ultra-wideband (UWB) antennas are typically excluded due to their dimensions and unnecessarily wide bandwidths. Planar inverted F-antennas (PIFAs) and other popular printable ESA antennas are suitable for 3G/4G devices but typically lack the efficiency needed for 5G devices.

SUMMARY

This disclosure provides a phased array for millimeter-wave (mmWave) mobile handsets and other devices.

In a first embodiment, an apparatus includes an antenna element. The antenna element includes a first portion of a multi-layer printed circuit board (PCB) and a cap covering at least part of the first portion of the multi-layer PCB. The multi-layer PCB includes multiple substrates, and the first portion of the multi-layer PCB includes a first slot through the multiple substrates. The cap includes a second slot and defines a space between the first portion of the multi-layer PCB and the cap. The cap and a conductive layer of the multi-layer PCB form a waveguide structure through which wireless signals radiate from the antenna element.

In a second embodiment, a system includes an antenna, a transceiver, receive processing circuitry, and transmit processing circuitry. The transceiver is configured to down-convert incoming signals received from the antenna and to up-convert outgoing signals to be transmitted by the antenna. The receive processing circuitry is configured to process the down-converted incoming signals. The transmit processing circuitry is configured to generate the outgoing signals. The antenna includes an antenna element. The antenna element includes a first portion of a multi-layer printed circuit board (PCB) and a cap covering at least part of the first portion of the multi-layer PCB. The multi-layer PCB includes multiple substrates, and the first portion of the multi-layer PCB includes a first slot through the multiple substrates. The cap includes a second slot and defines a space between the first portion of the multi-layer PCB and the cap. The cap and a conductive layer of the multi-layer PCB form a waveguide structure through which wireless signals radiate from the antenna element.

In a third embodiment, a method includes feeding signals to an antenna element. The antenna element includes a first portion of a multi-layer printed circuit board (PCB) and a cap covering at least part of the first portion of the multi-layer PCB. The multi-layer PCB includes multiple substrates, and the first portion of the multi-layer PCB includes a first slot through the multiple substrates. The cap includes a second slot and defines a space between the first portion of the multi-layer PCB and the cap. The method also includes radiating wireless signals from the antenna element through a waveguide structure formed by the cap and a conductive layer of the multi-layer PCB.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 20, discussed below, and the various embodiments used to describe the principles of the present invention in this patent document are by way of illustration only and should not be construed in any way to limit the scope of the disclosure. Those skilled in the art will understand that the principles of this disclosure may be implemented in any suitably arranged device or system.

Figure 1:
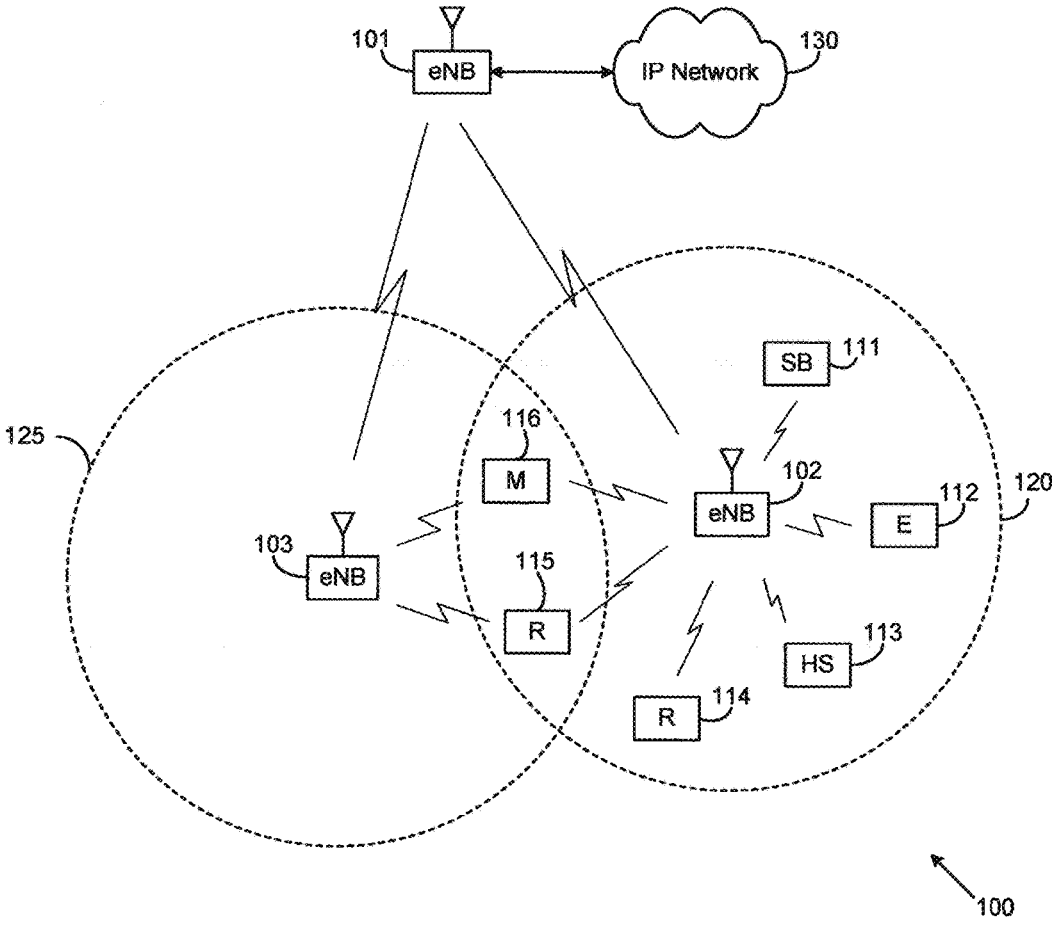
FIG. 1 illustrates an example wireless network according to this disclosure.

FIG. 1 illustrates an example wireless network 100 according to this disclosure. The embodiment of the wireless network 100 shown in FIG. 1 is for illustration only. Other embodiments of the wireless network 100 could be used without departing from the scope of this disclosure.

As shown in FIG. 1, the wireless network 100 includes an eNodeB (eNB) 101, an eNB 102, and an eNB 103. The eNB 101 communicates with the eNB 102 and the eNB 103. The eNB 101 also communicates with at least one Internet Protocol (IP) network 130, such as the Internet, a proprietary IP network, or other data network.

The eNB 102 provides wireless broadband access to the network 130 for a first plurality of user equipments (UEs) within a coverage area 120 of the eNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M) like a cell phone, a wireless laptop, a wireless PDA, or the like. The eNB 103 provides wireless broadband access to the network 130 for a second plurality of UEs within a coverage area 125 of the eNB 103. The second plurality of UEs includes the UE 115 and the UE 116. In some embodiments, one or more of the eNBs 101-103 may communicate with each other and with the UEs 111-116 using 5G, LTE, LTE-A, WiMAX, WiFi, or other wireless communication techniques.

Depending on the network type, other well-known terms may be used instead of "eNodeB" or "eNB," such as "base station" or "access point." For the sake of convenience, the terms "eNodeB" and "eNB" are used in this patent document to refer to network infrastructure components that provide wireless access to remote terminals. Also, depending on the network type, other well-known terms may be used instead of "user equipment" or "UE," such as "mobile station," "subscriber station," "remote terminal," "wireless terminal," or "user device." For the sake of convenience, the terms "user equipment" and "UE" are used in this patent document to refer to remote wireless equipment that wirelessly accesses an eNB, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with eNBs, such as the coverage areas 120 and 125, may have other shapes, including irregular shapes, depending upon the configuration of the eNBs and variations in the radio environment associated with natural and man-made obstructions.

As described in more detail below, one or more eNBs 101-103 and/or one or more UEs 111-116 include multi-element antenna arrays that support millimeter-wave (mmWave) communications. Depending on the implementation, the antenna arrays can represent low-cost and low-profile one-dimensional (1D) or two-dimensional (2D) arrays that use microstrip-to-waveguide transitions and low-cost metal caps or other caps to realize beam-steering in multiple dimensions. Moreover, an all-metallic case for mmWave devices can be used while maintaining needed or desired radiation performance and space coverage with a reduced or minimal number of antenna arrays.

Although FIG. 1 illustrates one example of a wireless network 100, various changes may be made to FIG. 1. For example, the wireless network 100 could include any number of eNBs and any number of UEs in any suitable arrangement. Also, the eNB 101 could communicate directly with any number of UEs and provide those UEs with wireless broadband access to the network 130. Similarly, each eNB 102-103 could communicate directly with the network 130 and provide UEs with direct wireless broadband access to the network 130. Further, the eNB 101, 102, and/or 103 could provide access to other or additional external networks, such as external telephone networks or other types of data networks.

Figure 2:
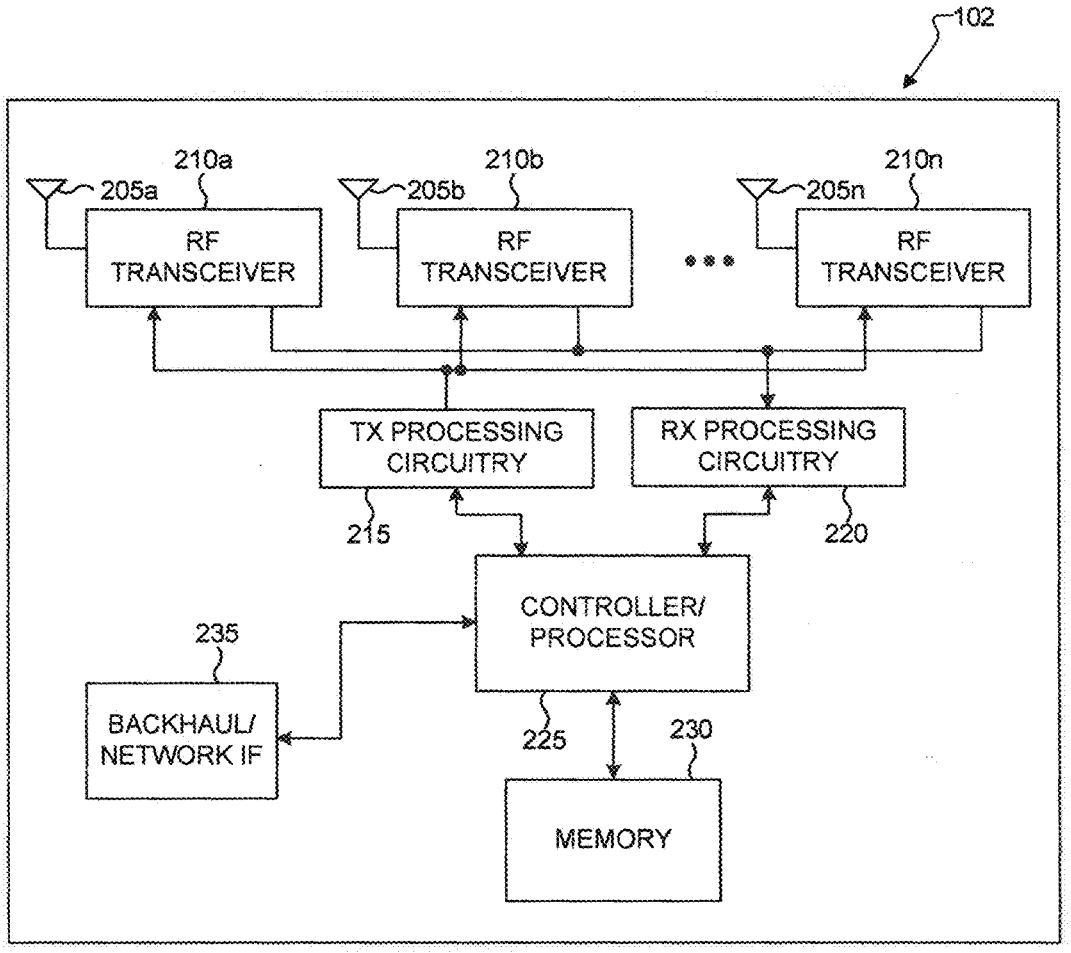
FIG. 2 illustrates an example eNodeB (eNB) according to this disclosure.

FIG. 2 illustrates an example eNB 102 according to this disclosure. The embodiment of the eNB 102 illustrated in FIG. 2 is for illustration only, and the eNBs 101 and 103 of FIG. 1 could have the same or similar configuration. However, eNBs come in a wide variety of configurations, and FIG. 2 does not limit the scope of this disclosure to any particular implementation of an eNB.

As shown in FIG. 2, the eNB 102 includes multiple antennas 205*a*-205*n*, multiple RF transceivers 210*a*-210*n*, transmit (TX) processing circuitry 215, and receive (RX) processing circuitry 220. The eNB 102 also includes a controller/processor 225, a memory 230, and a backhaul or network interface 235.

The RF transceivers 210*a*-210*n* receive, from the antennas 205*a*-205*n*, incoming RF signals, such as signals transmitted by UEs in the network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the eNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing signals from multiple antennas 205*a*-205*n* are weighted differently to effectively steer the outgoing signals in a desired direction. Any of a wide variety of other functions could be supported in the eNB 102 by the controller/processor 225. In some embodiments, the controller/processor 225 includes at least one microprocessor or microcontroller.

The controller/processor 225 is also capable of executing programs and other processes resident in the memory 230, such as a basic OS. The controller/processor 225 can move data into or out of the memory 230 as required by an executing process.

The controller/processor 225 is also coupled to the backhaul or network interface 235. The backhaul or network interface 235 allows the eNB 102 to communicate with other devices or systems over a backhaul connection or over a network. The interface 235 could support communications over any suitable wired or wireless connection(s). For example, when the eNB 102 is implemented as part of a cellular communication system (such as one supporting 5G, LTE, or LTE-A), the interface 235 could allow the eNB 102 to communicate with other eNBs over a wired or wireless backhaul connection. When the eNB 102 is implemented as an access point, the interface 235 could allow the eNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a random access memory (RAM), and another part of the memory 230 could include a Flash memory or other read-only memory (ROM).

As described in more detail below, one or more antennas 205*a*-205*n* in the eNB 102 could include multi-element antenna arrays that support mmWave communications. In particular embodiments, the eNB 102 could represent a WiFi access point. In some implementations, the access point could operate at mmWave frequencies, such as around 60 GHz.

Although FIG. 2 illustrates one example of eNB 102, various changes may be made to FIG. 2. For example, the eNB 102 could include any number of each component shown in FIG. 2. As a particular example, an access point could include a number of interfaces 235, and the controller/processor 225 could support routing functions to route data between different network addresses. As another particular example, while shown as including a single instance of TX processing circuitry 215 and a single instance of RX processing circuitry 220, the eNB 102 could include multiple instances of each (such as one per RF transceiver). Also, various components in FIG. 2 could be combined, further subdivided, or omitted and additional components could be added according to particular needs.

Figure 3:
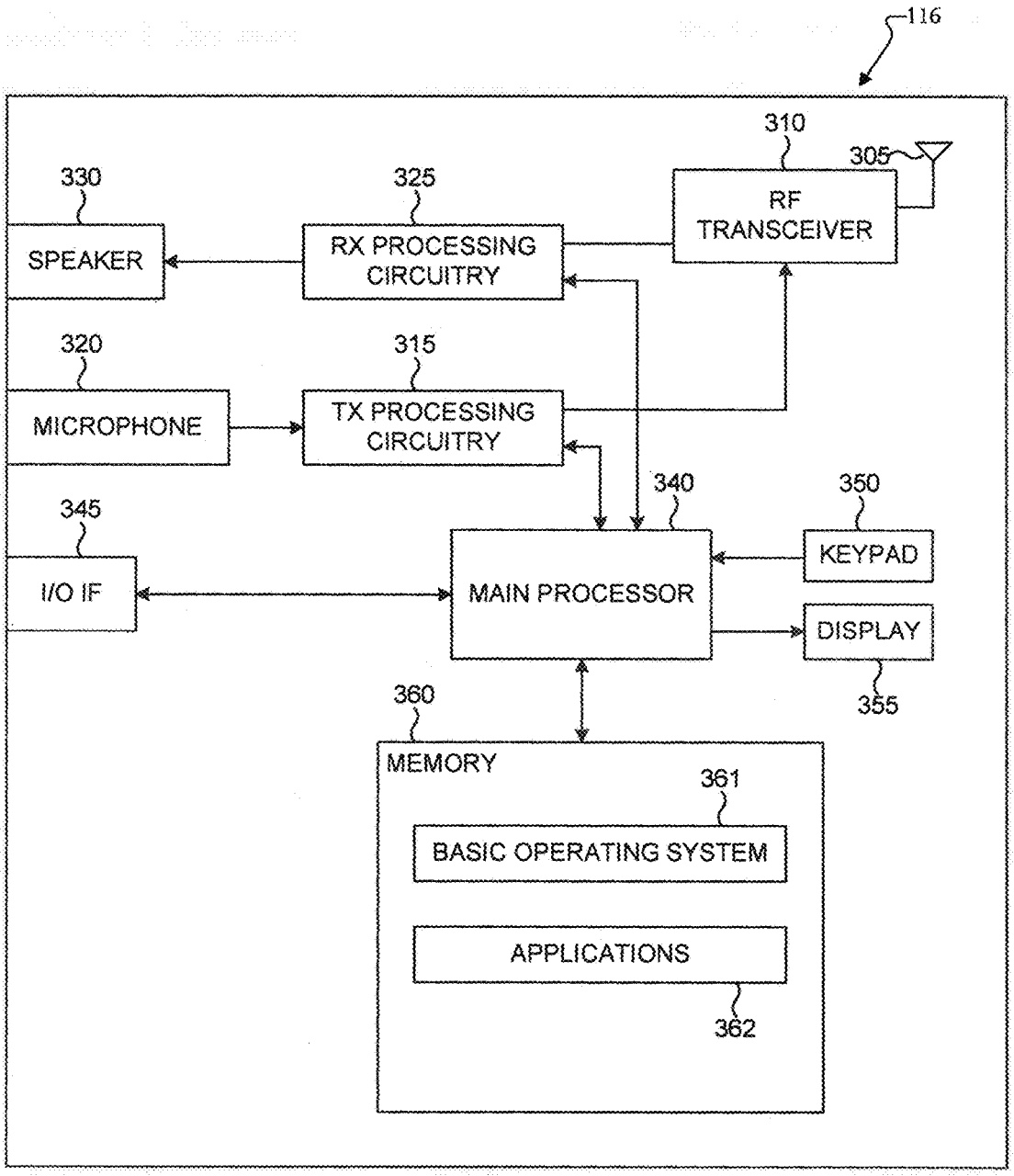
FIG. 3 illustrates an example user equipment (UE) according to this disclosure.

FIG. 3 illustrates an example UE 116 according to this disclosure. The embodiment of the UE 116 illustrated in FIG. 3 is for illustration only, and the UEs 111-115 of FIG. 1 could have the same or similar configuration. However, UEs come in a wide variety of configurations, and FIG. 3 does not limit the scope of this disclosure to any particular implementation of a UE.

As shown in FIG. 3, the UE 116 includes an antenna 305, a radio frequency (RF) transceiver 310, transmit (TX) processing circuitry 315, a microphone 320, and receive (RX) processing circuitry 325. The UE 116 also includes a speaker 330, a main processor 340, an input/output (I/O) interface (IF) 345, a keypad 350, a display 355, and a memory 360. The memory 360 includes a basic operating system (OS) program 361 and one or more applications 362.

The RF transceiver 310 receives, from the antenna 305, an incoming RF signal transmitted by an eNB of the network 100. The RF transceiver 310 down-converts the incoming RF signal to generate an intermediate frequency (IF) or baseband signal. The IF or baseband signal is sent to the RX processing circuitry 325, which generates a processed baseband signal by filtering, decoding, and/or digitizing the baseband or IF signal. The RX processing circuitry 325 transmits the processed baseband signal to the speaker 330 (such as for voice data) or to the main processor 340 for further processing (such as for web browsing data).

The TX processing circuitry 315 receives analog or digital voice data from the microphone 320 or other outgoing baseband data (such as web data, e-mail, or interactive video game data) from the main processor 340. The TX processing circuitry 315 encodes, multiplexes, and/or digitizes the outgoing baseband data to generate a processed baseband or IF signal. The RF transceiver 310 receives the outgoing processed baseband or IF signal from the TX processing circuitry 315 and up-converts the baseband or IF signal to an RF signal that is transmitted via the antenna 305.

The main processor 340 can include one or more processors or other processing devices and execute the basic OS program 361 stored in the memory 360 in order to control the overall operation of the UE 116. For example, the main processor 340 could control the reception of forward channel signals and the transmission of reverse channel signals by the RF transceiver 310, the RX processing circuitry 325, and the TX processing circuitry 315 in accordance with well-known principles. In some embodiments, the main processor 340 includes at least one microprocessor or microcontroller.

The main processor 340 is also capable of executing other processes and programs resident in the memory 360. The main processor 340 can move data into or out of the memory 360 as required by an executing process. In some embodiments, the main processor 340 is configured to execute the applications 362 based on the OS program 361 or in response to signals received from eNBs or an operator. The main processor 340 is also coupled to the I/O interface 345, which provides the UE 116 with the ability to connect to other devices such as laptop computers and handheld computers. The I/O interface 345 is the communication path between these accessories and the main processor 340.

The main processor 340 is also coupled to the keypad 350 and the display unit 355. The operator of the UE 116 can use the keypad 350 to enter data into the UE 116. The display 355 may be a liquid crystal display or other display capable of rendering text and/or at least limited graphics, such as from web sites.

The memory 360 is coupled to the main processor 340. Part of the memory 360 could include a RAM, and another part of the memory 360 could include a Flash memory or other ROM.

As described in more detail below, the antenna 305 in the eNB 102 could include a multi-element antenna array that supports mmWave communications. In particular embodiments, the UE 116 could represent a 5G smartphone or other 5G device.

Although FIG. 3 illustrates one example of UE 116, various changes may be made to FIG. 3. For example, various components in FIG. 3 could be combined, further subdivided, or omitted and additional components could be added according to particular needs. As a particular example, the main processor 340 could be divided into multiple processors, such as one or more central processing units (CPUs) and one or more graphics processing units (CPUs). Also, while FIG. 3 illustrates the UE 116 configured as a mobile telephone or smartphone, UEs could be configured to operate as other types of mobile or stationary devices.

Figure 4A:
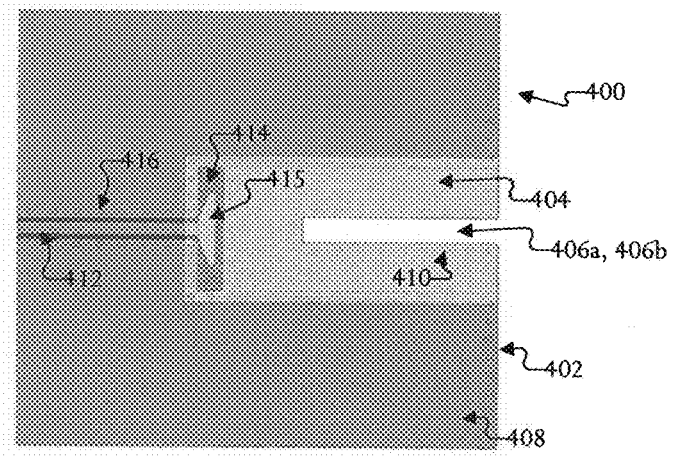
FIGS. 4A through 9 illustrate an example antenna element and related details according to this disclosure.
Figure 4B:
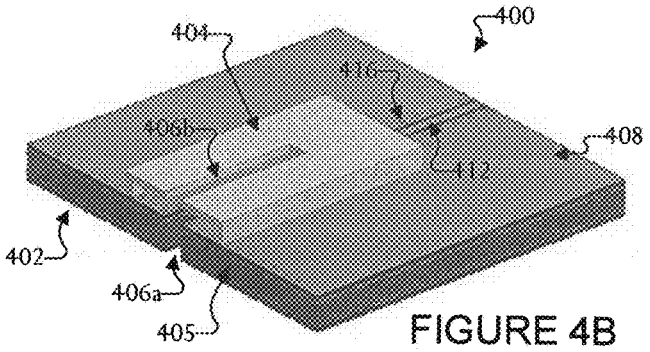
Figure 4C:
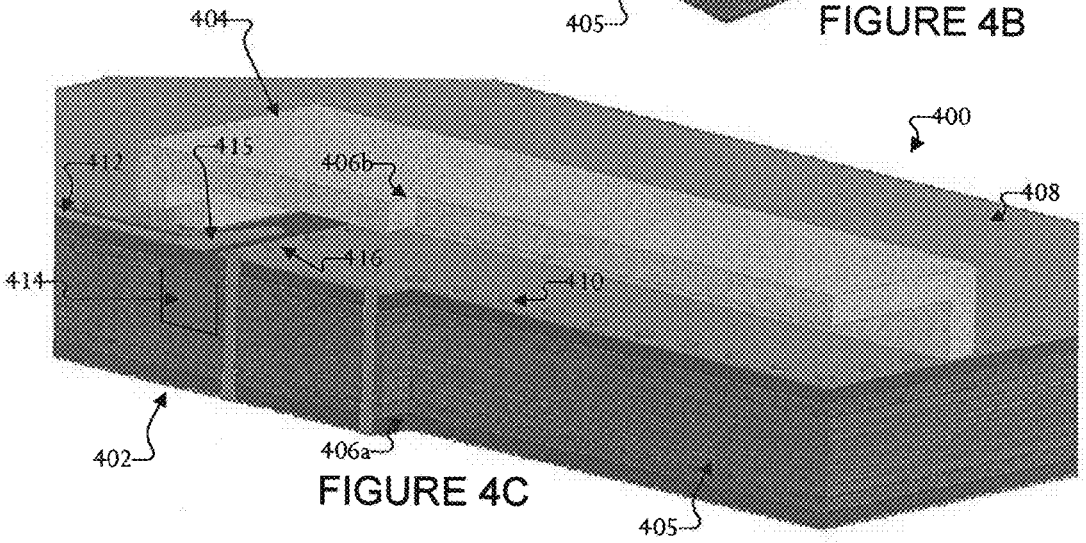

FIGS. 4A through 9 illustrate an example antenna element 400 and related details according to this disclosure. As shown in FIGS. 4A through 4C, the antenna element 400 is formed using a multi-layer printed circuit board (PCB) 402 and a metal or other conductive cap 404. The cap 404 covers at least part of the PCB 402 and defines a space between the PCB 402 and the cap 404 (and the space may or may not be filled with other material(s)). The PCB 402 can be formed using multiple substrates 405, which can be joined via laminating or other suitable process. The PCB 402 also includes a slot 406*a*, and the cap 404 has a matching slot 406*b* for impedance matching purpose. The PCB 402 includes any multi-layer PCB having a suitable number of layers. The cap 404 includes any suitable conductive structure placed over a PCB. The cap 404 could be formed from any suitable conductive material(s) (such as one or more metals) and in any suitable manner (such as machining or mold casting). The slots 406*a*-406*b* could be formed in the PCB 402 and cap 404, respectively, in any suitable manner, such as by routing.

The PCB 402 further includes a top layer 408 that can be formed from a metal or other conductive material(s). The top layer 408 of the PCB 402 and the cap 404 form a waveguide structure that radiates waves towards the slot direction with a fan beam (very wide beamwidth). In addition, the PCB 402 includes a number of vias that are filled with conductive material(s), including vias 410 that surround three sides of the slot 406*a* and help to shield the slot 406*a*.

Figure 5A:
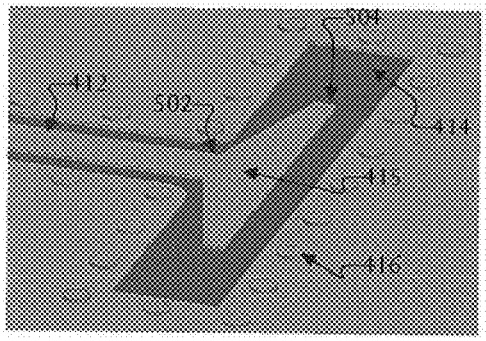
Figure 5B:
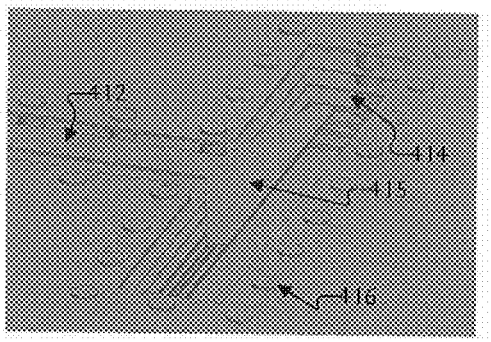

The antenna element 400 is excited using a feed line 412, such as a coplanar waveguide (CPW) feed line. The feed line 412 feeds a signal into a mode transit cavity 414. A cavity-based feed line-to-waveguide transition 415 is located adjacent to the cavity 414 and can be designed to provide a smooth mode transit, and its structure is detailed in FIGS. 5A and 5B. In FIG. 5A, the underlying substrates 405 of the PCB 402 are shown, while the underlying substrates 405 of the PCB 402 are omitted in FIG. 5B.

As shown in FIGS. 4A through 5B, the cavity 414 extends through several substrate layers under the top layer 408. The material(s) forming the top layer 408 can be etched or otherwise processed to form the feed line 412 and the feed line-to-waveguide transition 415. The number of substrate layers used to form the cavity 414 can be determined, among other things, by the operating frequency of this transit. Additional vias 416 can be formed around the feed line 412 and the cavity 414 and filled with conductive material(s). The center conductor of the feed line 412 tapers inside the cavity 414 from a narrower width at one end 502 to a maximum width at the opposite end 504 to form the transition 415. This taper helps the antenna element 400 to obtain better impedance matching.

Figure 6:
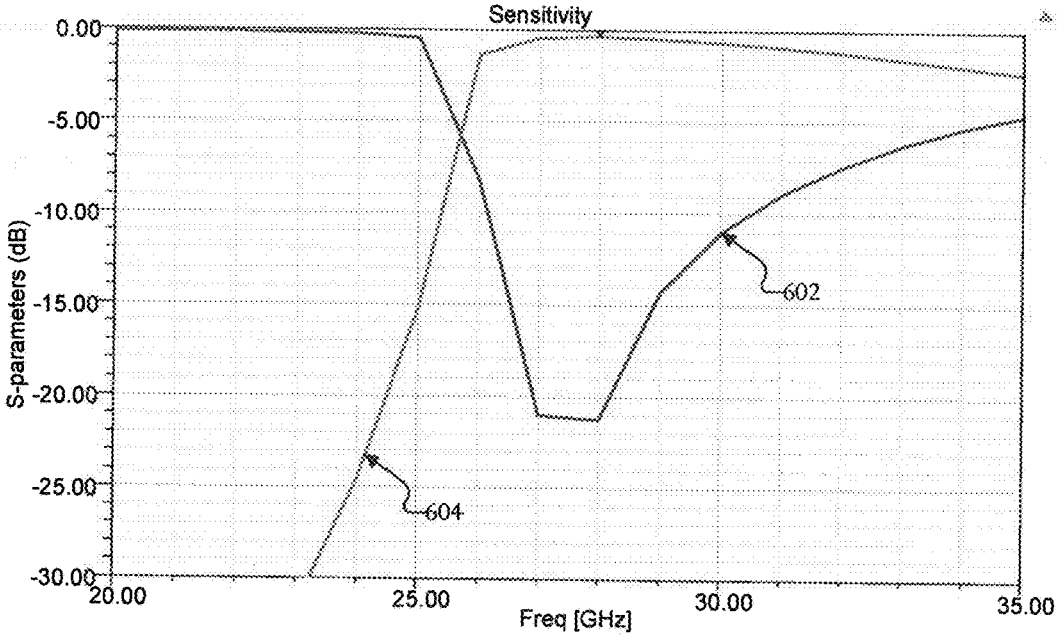

A simulated performance of a CPW-to-waveguide transit of the antenna element 400 is shown in FIG. 6. A line 602 represents a reflection coefficient (S11) value and a line 604 represents a transmission coefficient (S21) value (both expressed in decibels) of the antenna element 400 as functions of frequency. With FR4 or other woven fiberglass with an epoxy resin binder as the dielectric within the cavity 414, a 0.37 dB insertion loss is obtained with more than a 4 GHz bandwidth for a reflection coefficient (S11 value) less than −10 dB.

Figure 7:
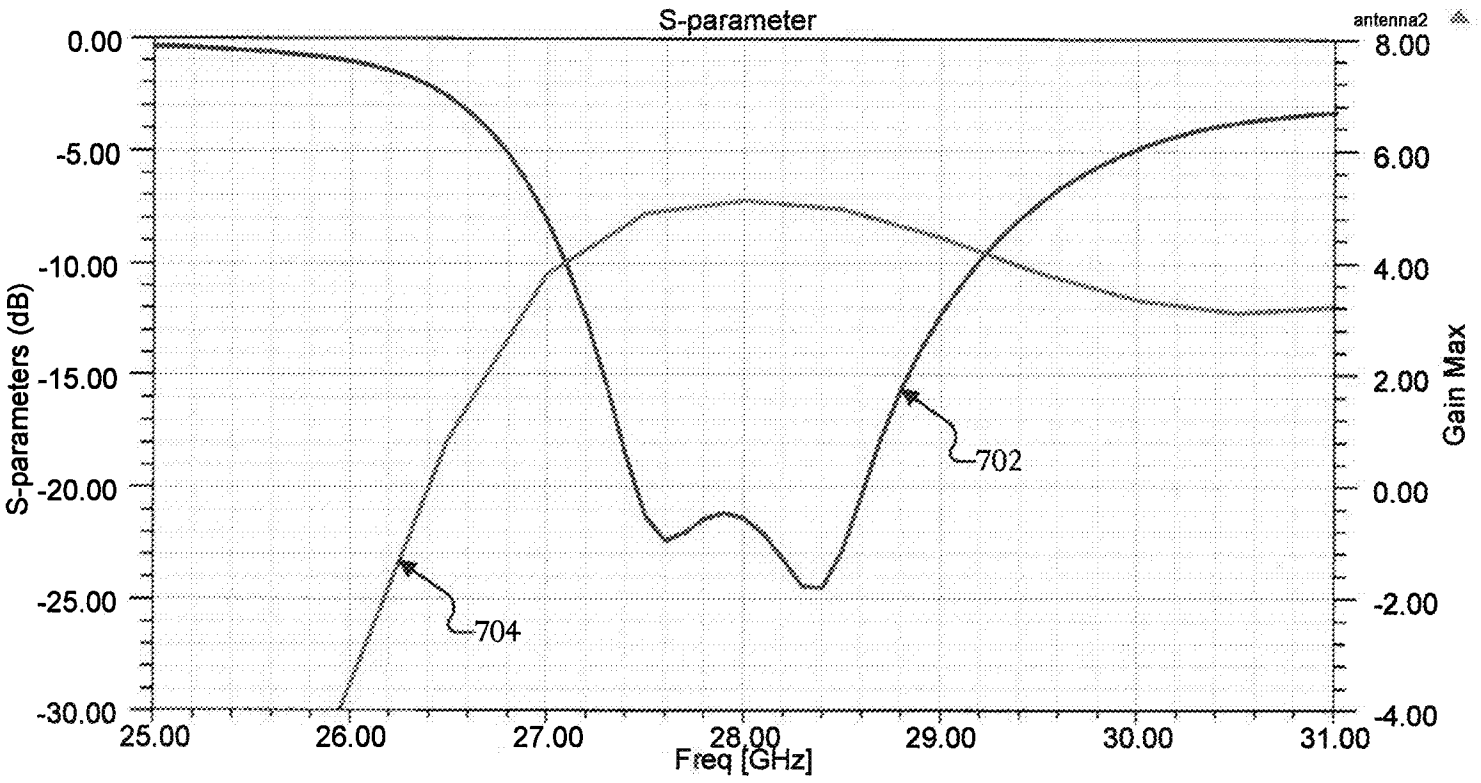
Figure 8A:
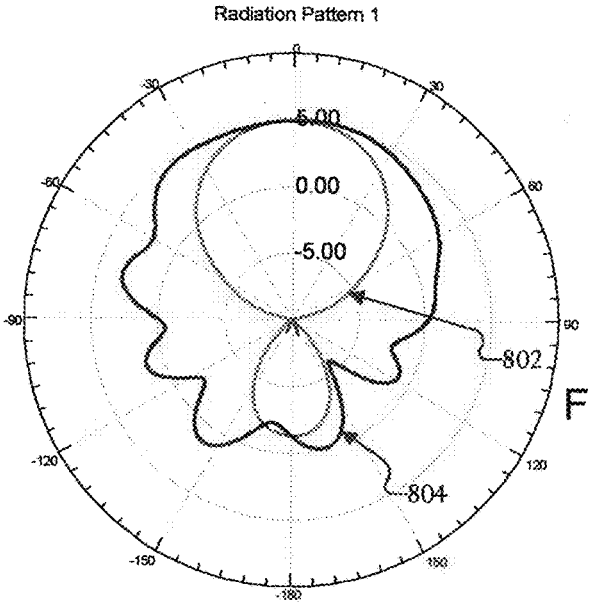
Figure 8B:
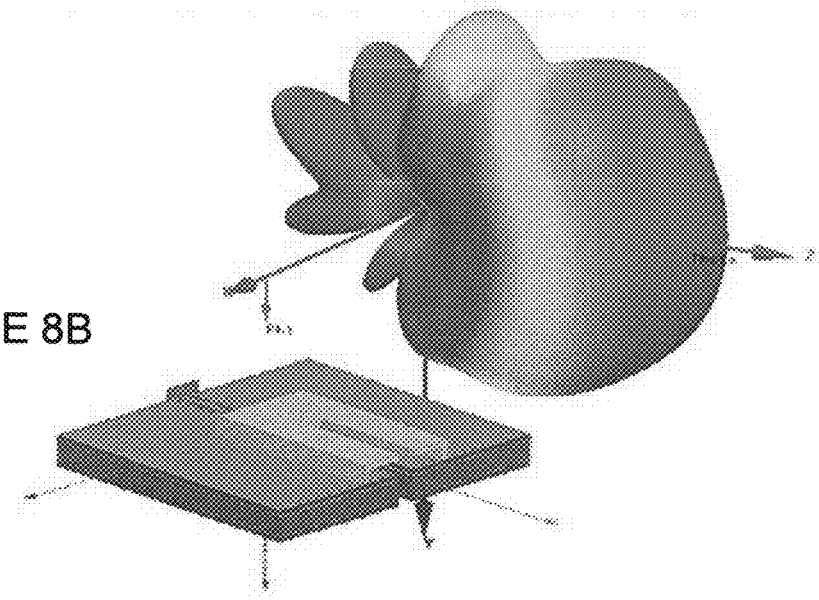

Simulated impedance and gain performance of the antenna element 400 are shown in FIG. 7. A line 702 represents the reflection coefficient (S11) value and a line 704 represents the gain of the antenna element 400 as functions of frequency. Simulated radiation patterns of the antenna element 400 at 28 GHz are shown in FIG. 8A (a 2D radiation pattern) and FIG. 8B (a 3D radiation pattern). In FIG. 8A, a line 802 denotes the realized gain (phi) at 0°, and a line 804 denotes the realized gain (theta) at 90°.

Figure 9:
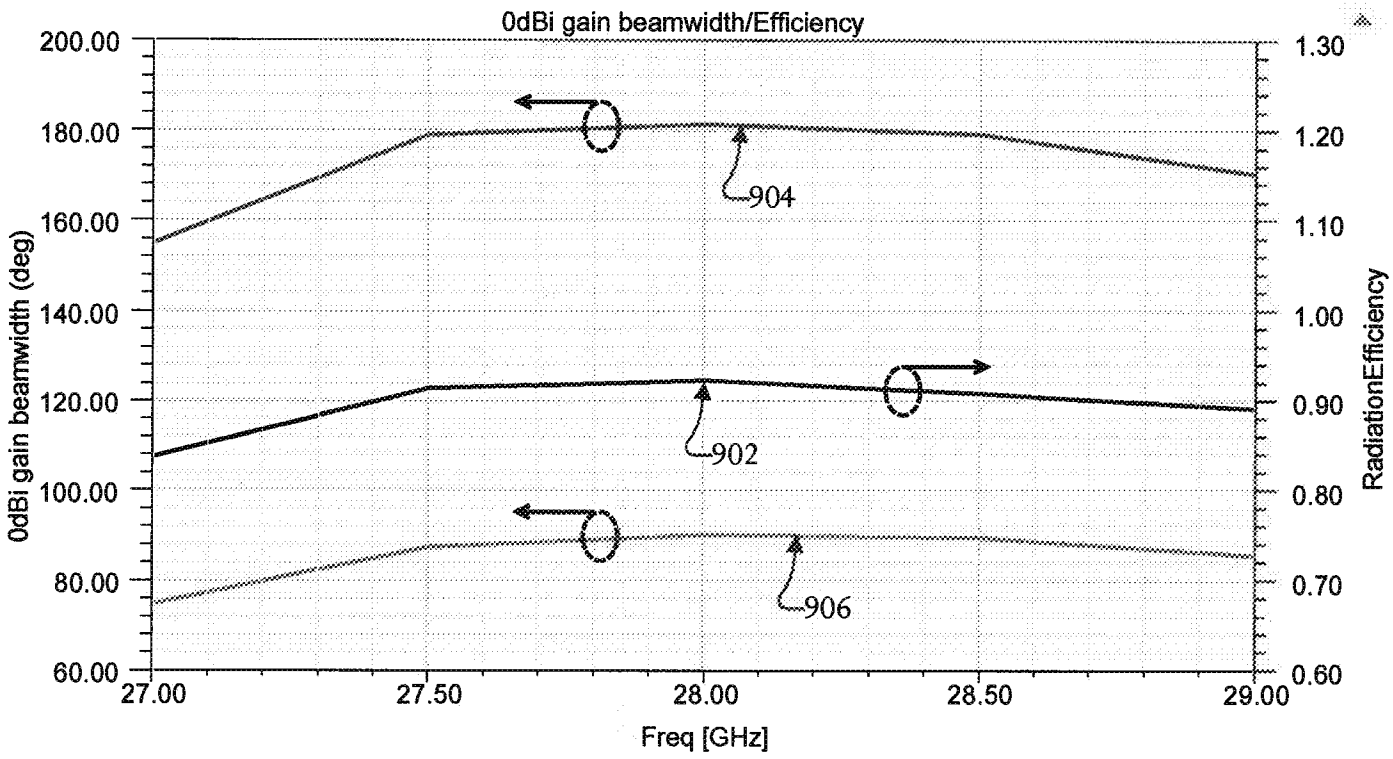
Figure 10A:
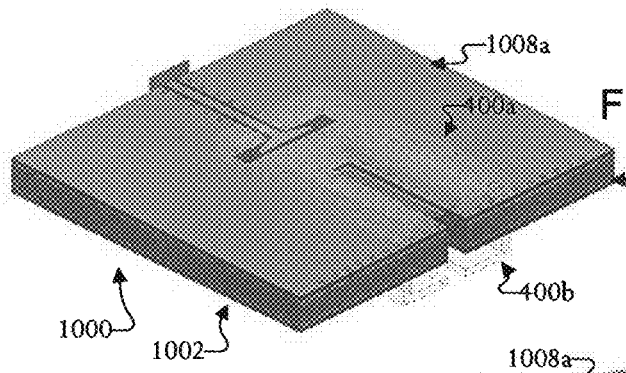
FIGS. 10A through 12F illustrate an example one-dimensional (1D) multi-element antenna array and related details according to this disclosure.
Figure 10B:
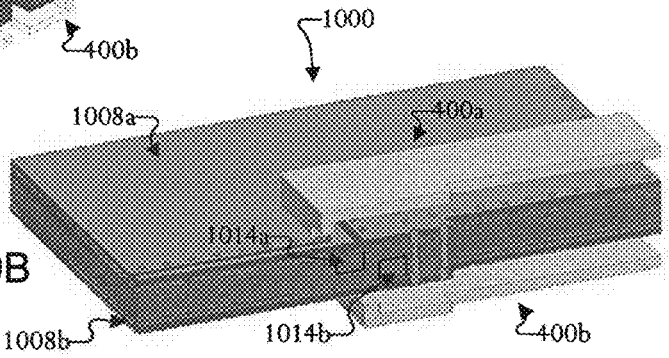
Figure 10C:
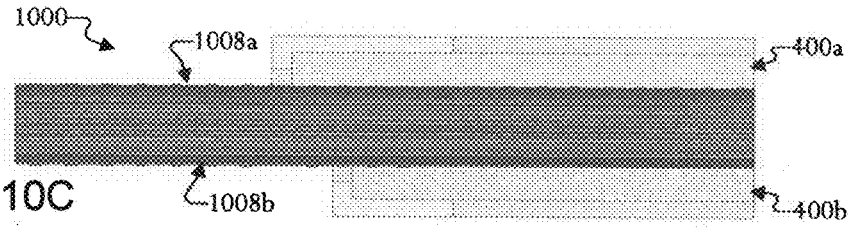
Figure 10D:
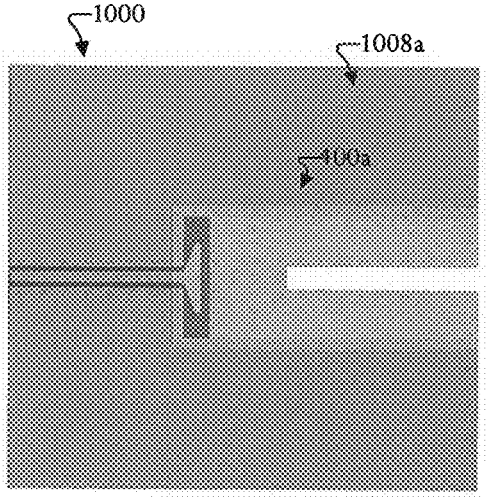
Figure 10E:
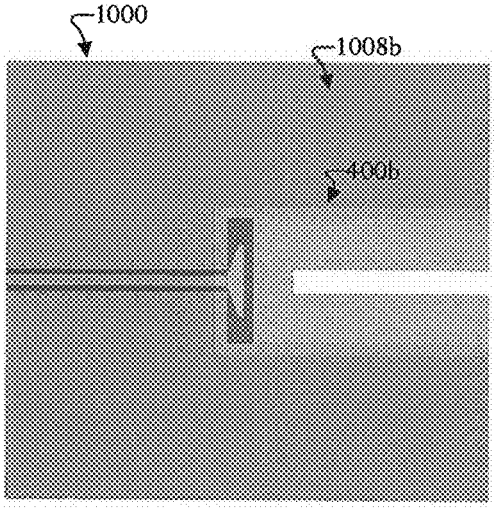

Simulated 0 dBi gain beamwidth and radiation efficiency of the antenna element 400 are shown in FIG. 9. A line 902 denotes the radiation efficiency of the antenna element 400, and lines 904-906 denote the E-plane and H-plane beamwidths, respectively, of the antenna element 400. It can be clearly seen here that the antenna element 400 has good gain with 180°/90° 0 dBi gain beamwidths in E-/H-plane, respectively. The relatively high gain with wide beamwidth benefits from the high radiation efficiency due to an air-filled waveguide radiator (formed by the top layer top layer 408 and the cap 404). The antenna element 400 also features a more than 2 GHz bandwidth.

In some embodiments, the antenna element 400 can be fabricated using standard PCB fabrication techniques, so no additional costs may be needed to fabricate the antenna element 400. The cap 404 can also be easily fabricated, such as by machining or mold casting. The cap 404 can further be attached to the PCB 402 in any suitable manner, such as with conductive epoxy, soldered using surface mount technology (SMT), or screwed onto the PCB 402. Note that 90° corners of the cap 404 could be rounded for easier fabrication without affecting performance. The end of the slot 406*a* in the PCB 402 can also be rounded for the same reasons.

FIGS. 10A through 12F illustrate an example 1D multi-element antenna array 1000 and related details according to this disclosure. The antenna array 1000 here includes two antenna elements 400*a*-400*b*, which can have the same or similar structure as the antenna element 400 described above. In this example, the antenna element 400*a* is formed on a top layer 1008*a* of a multi-layer PCB 1002, and the antenna element 400*b* is formed on a bottom layer 1008*b* of the multi-layer PCB 1002. Each antenna element 400*a*-400*b* can include the same cap and feed line-to-waveguide mode transit structure described above.

As shown here, the lower antenna element 400*b* is offset with respect to the position of the upper antenna element 400*a*. This offset helps to avoid cavities 1014*a*-1014*b* of the antenna elements 400*a*-400*b* from overlapping one another, which could significantly weaken the PCB 1002.

The antenna elements 400*a*-400*b* can be excited in any suitable manner. For example, separate RF chains can be used to excite the antenna elements 400*a*-400*b*. Also, a through-board microstrip signal transit could be used to guide a signal from an RF chain on top of the PCB 1002 to the bottom antenna element 400*b* (or vice versa).

In particular embodiments, the total thickness of the antenna array 1000 is 215 mils (5.4 mm or 0.5λ), which includes 60 mils for the caps 404 of the antenna elements 400*a*-400*b* and 95 mils for the multi-layer PCB 1002. This type of low profile easily enables integration of the antenna array 1000 with future 5G smartphones or other devices. Also, in particular embodiments, the length and width of the antenna array 1000 are 440 mils (11 mm) and 270 mils (6.8 mm), respectively, and the wall thickness of the caps 404 of the antenna elements 400*a*-400*b* is 20 mils (0.5 mm).

Figure 11:
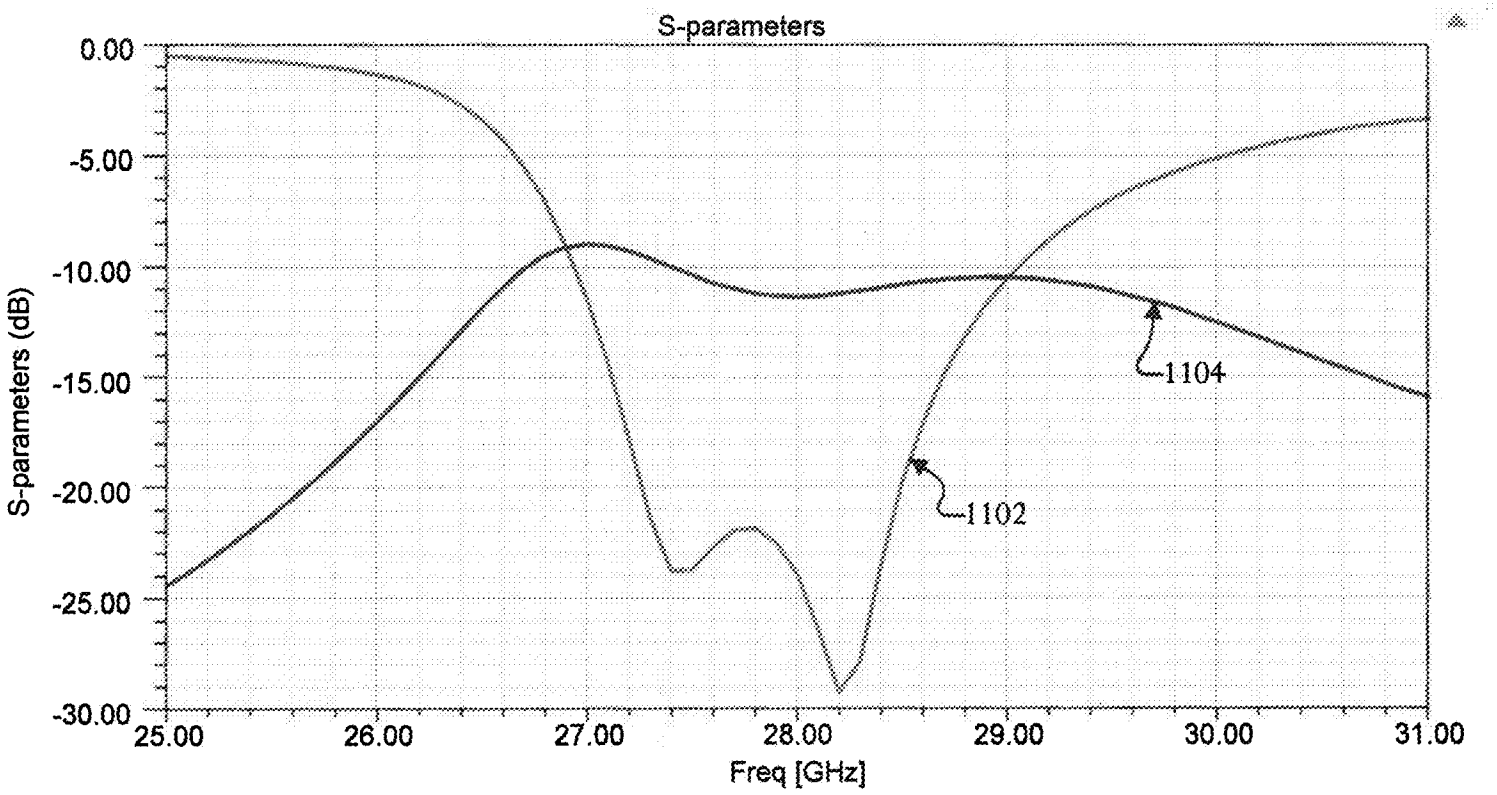

Simulated S-parameters of the antenna array 1000 are shown in FIG. 11. A line 1102 represents a reflection coefficient (S11) value and a line 1104 represents a transmission coefficient (S21) value (both expressed in decibels) of the antenna array 1000 as functions of frequency. As can be seen here, the antenna array 1000 is well-matched from 27 GHz to 29 GHz. The element isolation is around 10 dB throughout the band due to the close separation between the antenna elements 400*a*-400*b*. This isolation can be improved in various ways, such as by using thicker caps 404, thicker PCBs 1002, or spacers to increase the antenna element separation.

Figure 12A:
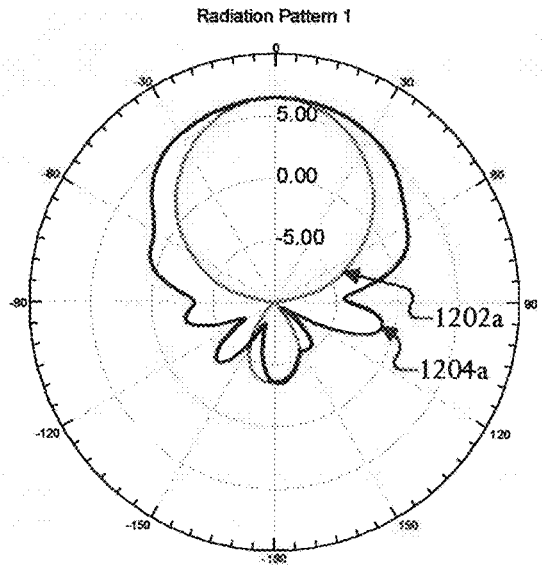
Figure 12B:
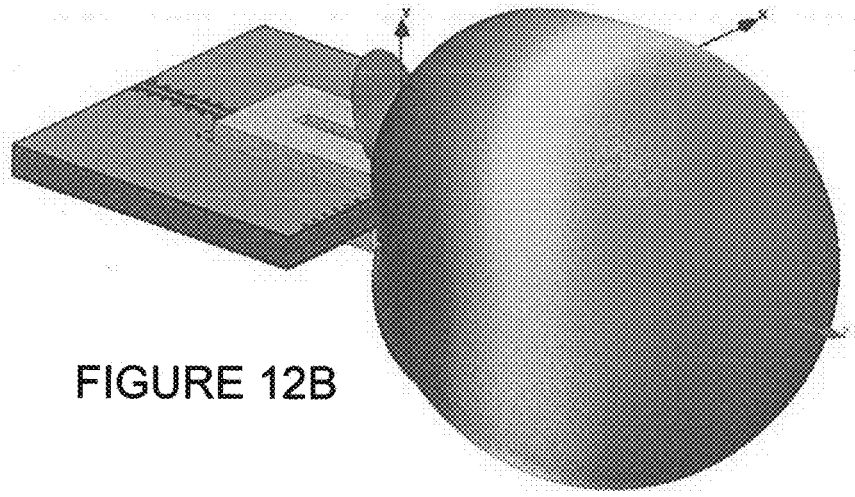
Figure 12C:
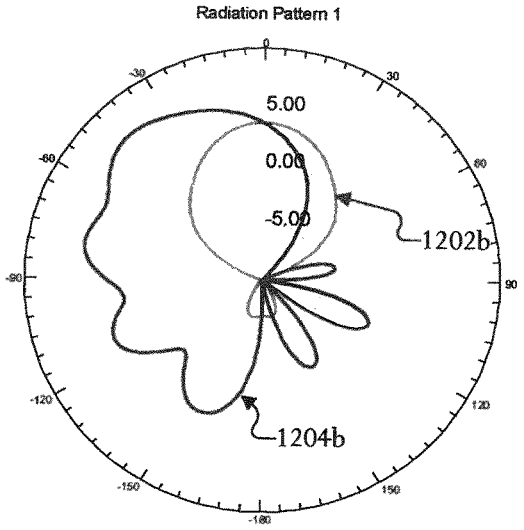
Figure 12D:
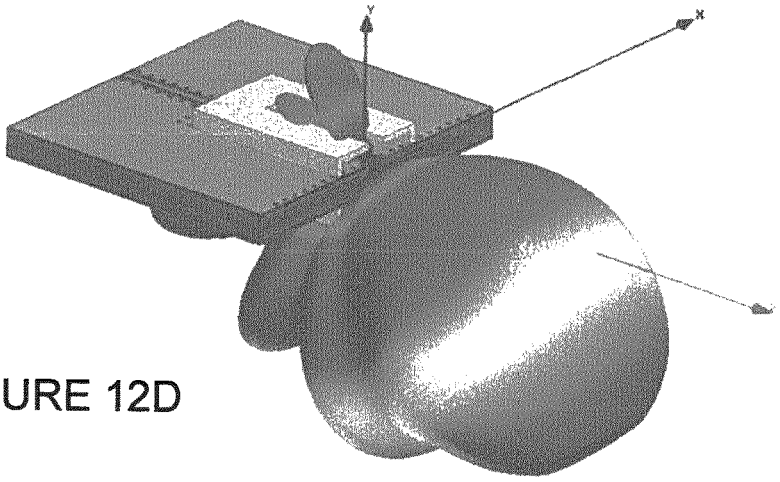
Figure 12E:
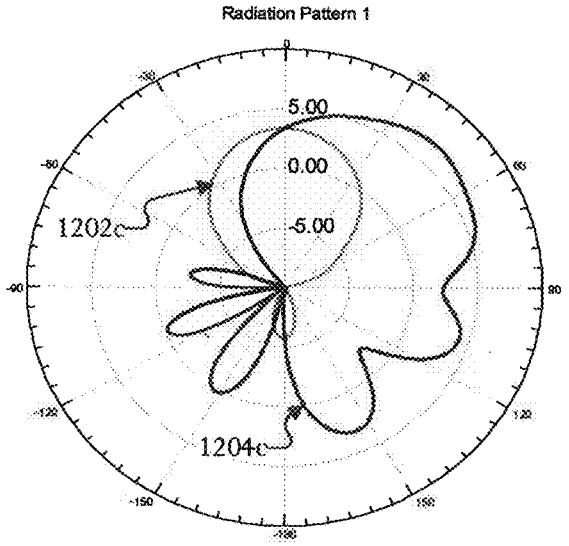
Figure 12F:
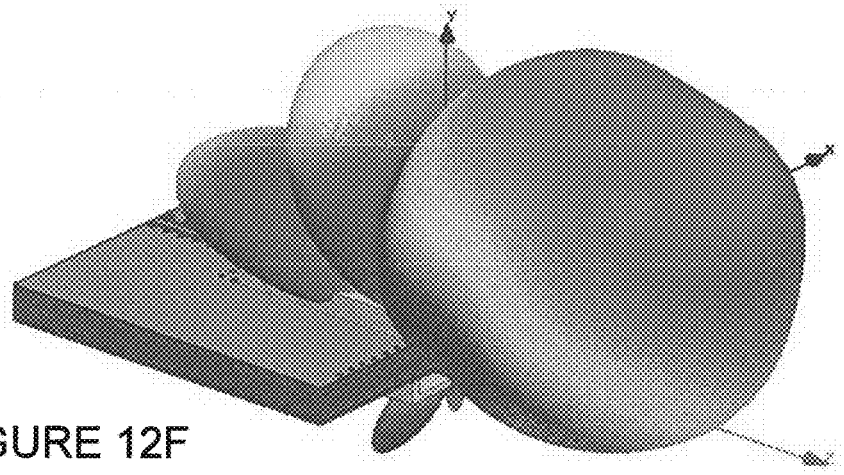
Figure 13A:
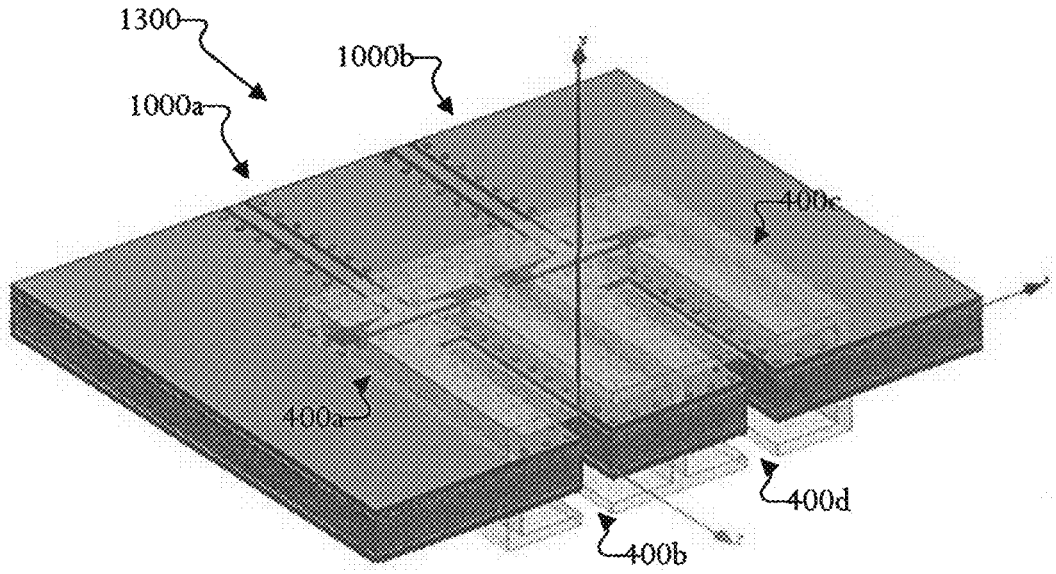
FIGS. 13A through 14C illustrate an example two-dimensional (2D) multi-element antenna array and related details according to this disclosure.
Figure 13B:
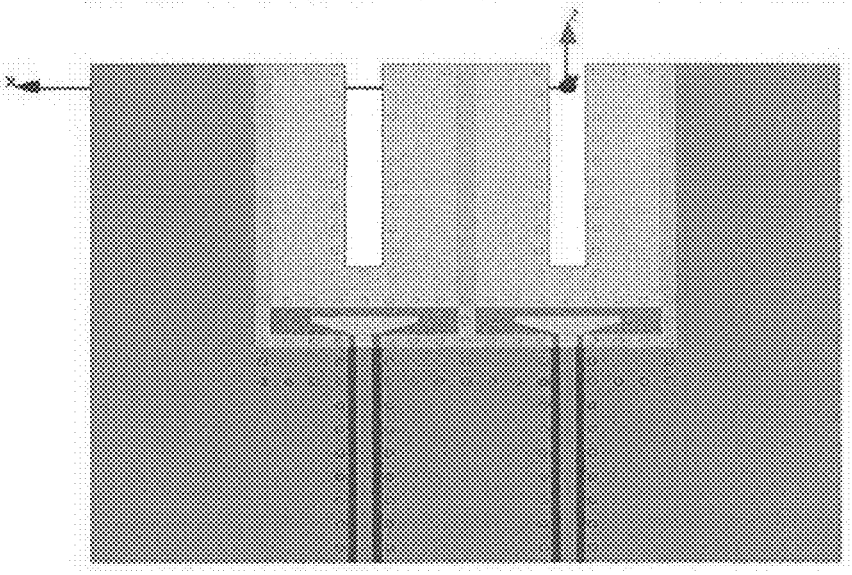

FIGS. 12A through 12F illustrate simulated antenna radiation patterns of the antenna array 1000 at 28 GHz for different steering angles. In particular, FIGS. 12A and 12B illustrate the simulated antenna radiation pattern of the antenna array 1000 without beam steering. FIGS. 12C and 12D illustrate the simulated antenna radiation pattern of the antenna array 1000 with beam steering towards the bottom the array 1000. FIGS. 12E and 12F illustrate the simulated antenna radiation pattern of the antenna array 1000 with beam steering towards the top the array 1000.

In FIGS. 12A, 12C, and 12E, lines 1202*a*-1202*c* denote the realized gains (phi) at 0°, and lines 1204*a*-1204*c* denote the realized gains (theta) at 90°. The peak realized gain is around 6.7 dBi for all three cases. Minimal realized gain at the coverage extremes (±45° in azimuth and ±90° in elevation) is around 3 dBi.

FIGS. 13A through 14C illustrate an example 2D multi-element antenna array 1300 and related details according to this disclosure. The 2D antenna array 1300 is formed using a pair of the antenna arrays 1000*a*-1000*b*, each of which could be the same as or similar to the antenna array 1000 described above. As a result, the antenna array 1300 represents a two-by-two collection of antenna elements 400*a*-400*d*. Note that the caps (such as caps 404) of multiple antenna elements can be integrated into a single structural unit, such as when a single cap is used for the antenna elements 400*a*, 400*c* and a single cap is used for the antenna elements 400*b*, 400*d*. In these cases, each antenna element includes its own cap, even if that cap represents part of an integrated structure.

In some embodiments, the horizontal separation between two antenna elements 400*a*, 400*c* or 400*b*, 400*d* is 250 mils (6.4 mm or 0.6λ), and the total array dimension is 520 mils (13 mm) by 440 mils (11 mm) by 215 mils (5.4 mm). This two-by-two array 1300 enables two-dimensional beam steering in both azimuth (x-z plane) and elevation (y-z plane) planes as shown in FIGS. 14A-14C, which is not typically possible with existing designs that use linear arrays along the PCB.

Figure 14A:
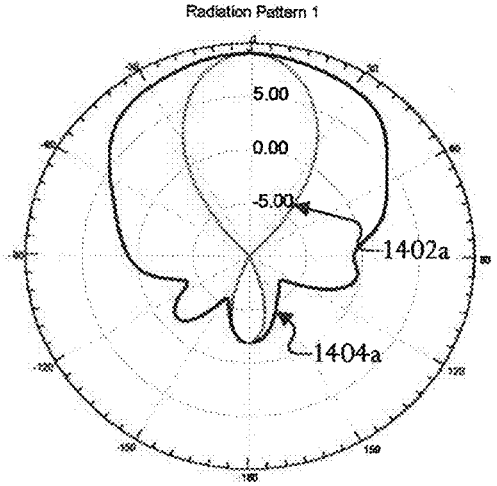
Figure 14B:
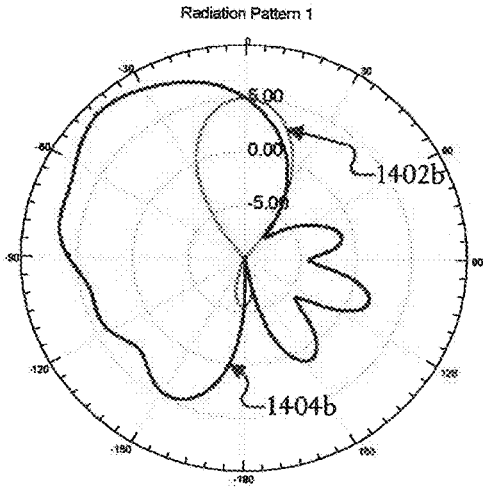
Figure 14C:
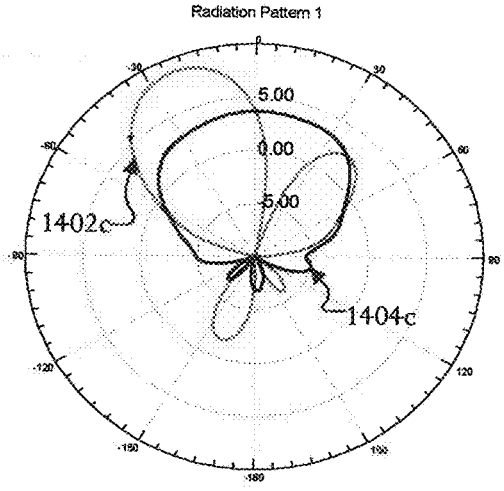

FIG. 14A illustrates the simulated antenna radiation pattern of the antenna array 1300 without beam steering. FIG. 14B illustrates the simulated antenna radiation pattern of the antenna array 1300 with beam steering to −45° in elevation. FIG. 14C illustrates the simulated antenna radiation pattern of the antenna array 1300 with beam steering to −25° in azimuth. In FIGS. 14A-14C, lines 1402*a*-1402*c* denote the realized gains (phi) at 0°, and lines 1404*a*-1404*c* denote the realized gains (theta) at 90°.

Figure 15A:
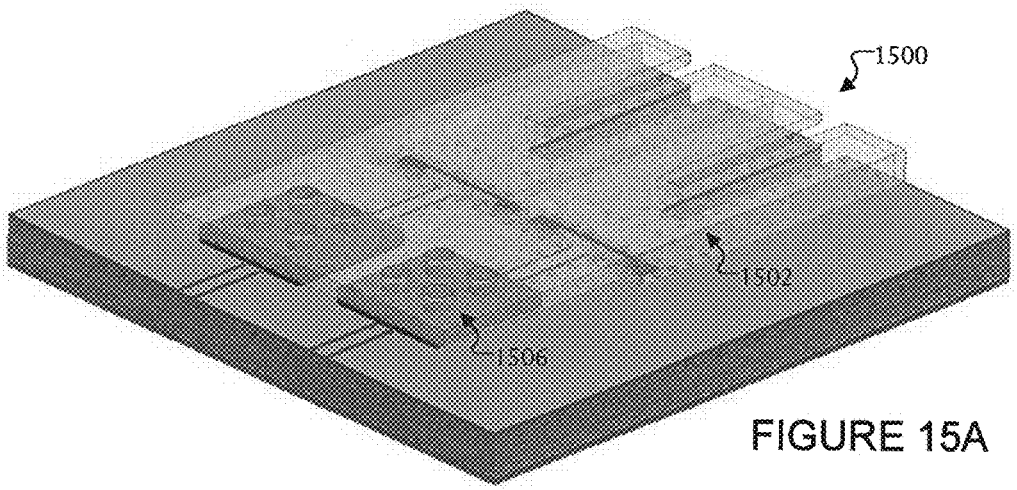
FIGS. 15A through 15C illustrate another example 2D multi-element antenna array and related details according to this disclosure.
Figure 15B:
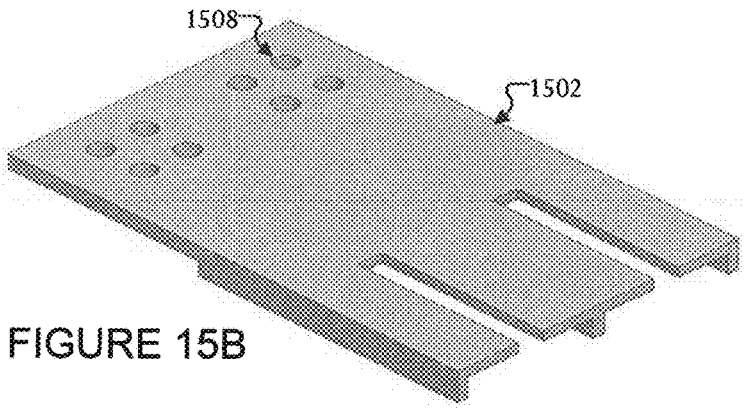
Figure 15C:
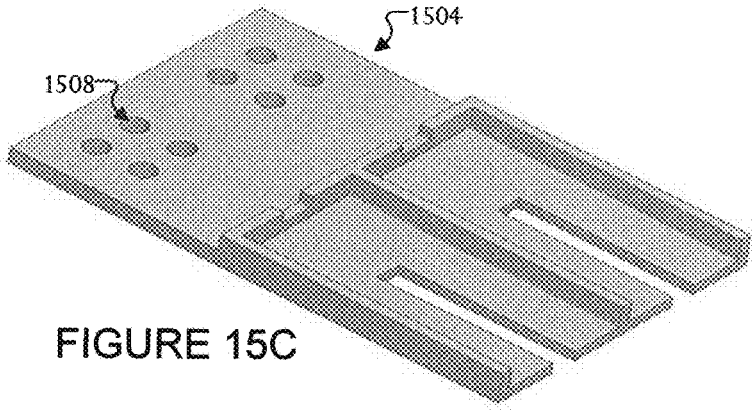

FIGS. 15A through 15C illustrate another example 2D multi-element antenna array 1500 and related details according to this disclosure. In FIGS. 15A through 15C, the antenna array 1500 includes caps 1502-1504 in place of the caps 404. The caps 1502-1504 again include slots that match slots of a multi-layer PCB. However, the caps 1502-1504 are extended to also cover one or more power amplifiers 1506. Each power amplifier 1506 can be coupled to a feed line and feed one of the antenna elements in the array 1500. Each power amplifier 1506 includes any suitable structure for amplifying a signal.

In this example, the caps 1502-1504 can be used as a heat sink for the power amplifiers 1506, effectively reducing the board temperature and increasing overall system stability. In some embodiments, the caps 1502-1504 can be made of copper or aluminum for performance or cost considerations. Also, the extensions of the caps 1502-1504 (compared to the caps 404) can be as close as possible to the power amplifiers 1506 after taking in consideration the tolerance of the power amplifiers' heights. In some embodiments, each cap 1502-1504 includes or more recesses 1508 in which thermal paste or other suitable adhesive could be used to secure the cap to the power amplifier(s) 1506. This allows the gap between the power amplifiers 1506 and the caps 1502-1504 to be filled using thermal paste or other heat-conducting material(s).

Figure 16A:
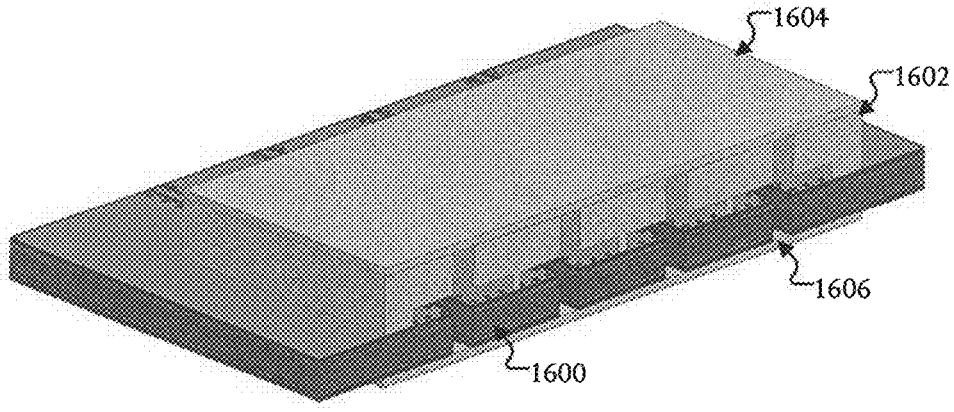
FIGS. 16A through 19F illustrate another example 1D antenna array and related detail according to this disclosure.
Figure 16B:
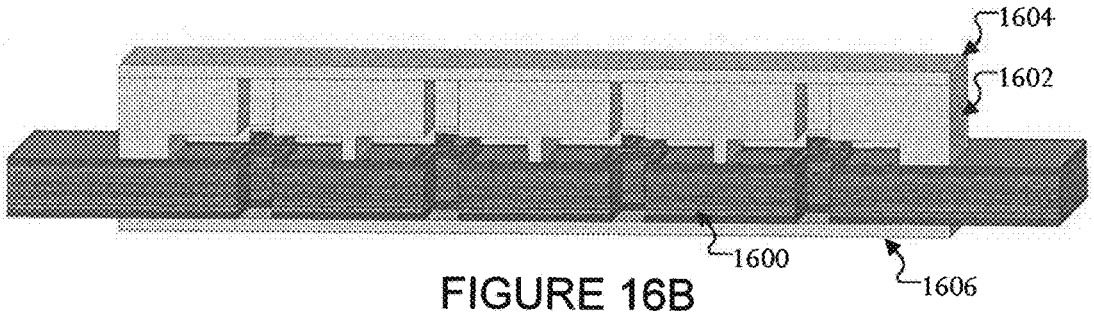

FIGS. 16A through 19F illustrate another example 1D antenna array 1600 and related detail according to this disclosure. In FIGS. 16A and 16B, a four-by-one antenna array 1600 is formed using four antenna elements (such as the antenna elements 400) placed on the same side of a multi-layer PCB. Also, a cap 1602 similar to the cap 1502 (but extended to cover four antenna elements) can be placed over one side of the multi-layer PCB, and a slab 1604 can be placed over the cap 1602 on the upper side of the PCB.

Another slab 1606 can be placed over the lower side of the PCB. Each slab 1604-1606 could be formed from any suitable material(s) (such as one or more metals) and in any suitable manner. Compared to the cap 1502, the cap 1602 can have a larger thickness in order to increase the slot depth of the cap 1602.

In some embodiments, the overall thickness of the antenna array 1600 is 265 mils (6.6 mm). One possible advantage of this embodiment is that the antenna array 1600 can be completely covered with metal except its front area, which allows for an all-metallic working environment without degrading the array's radiating performance. Also, in some embodiments, the cap 1602 can be extended as is done in FIGS. 15A through 15*c* in order to cover or thermally contact one or more power amplifiers.

Figure 17A:
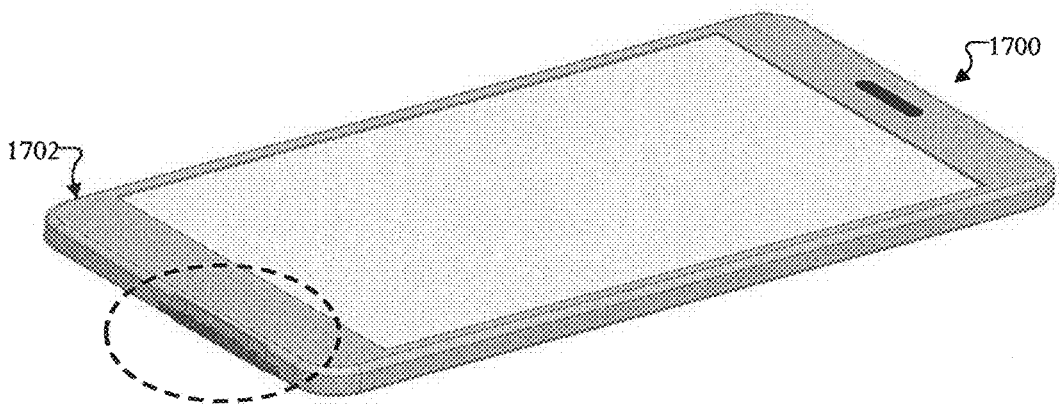
Figure 17B:
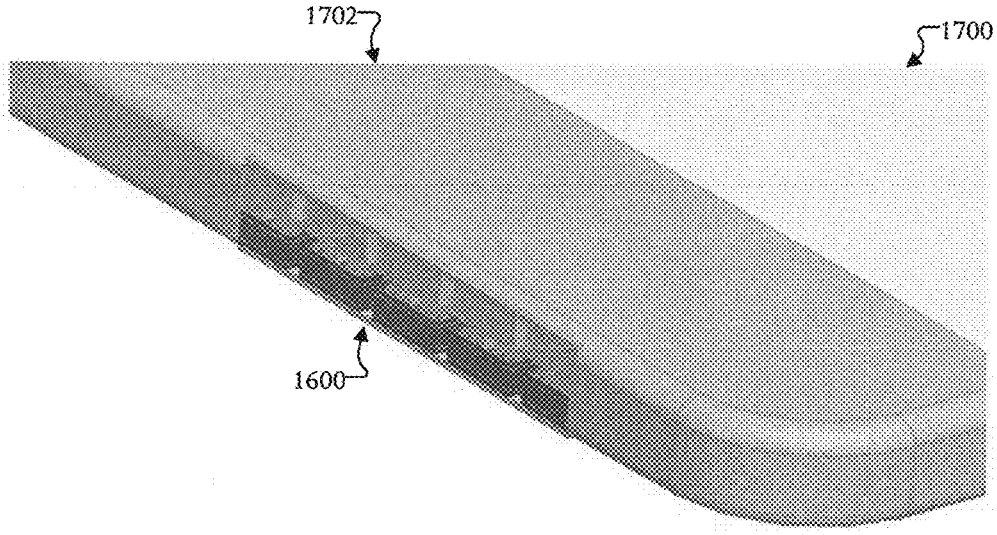

FIGS. 17A and 17B illustrate an example UE 1700 with the multi-element antenna array 1600. The UE 1700 here represents a mobile smartphone or other portable device, and a cover 1702 of the UE 1700 can be all metallic. The use of an all-metallic cover can be beneficial both in terms of appearance and (along with the cap 1602 and slabs 1604-1606) in terms of heat dissipation, which are not well-addressed even in 3G/4G handsets.

Figure 18:
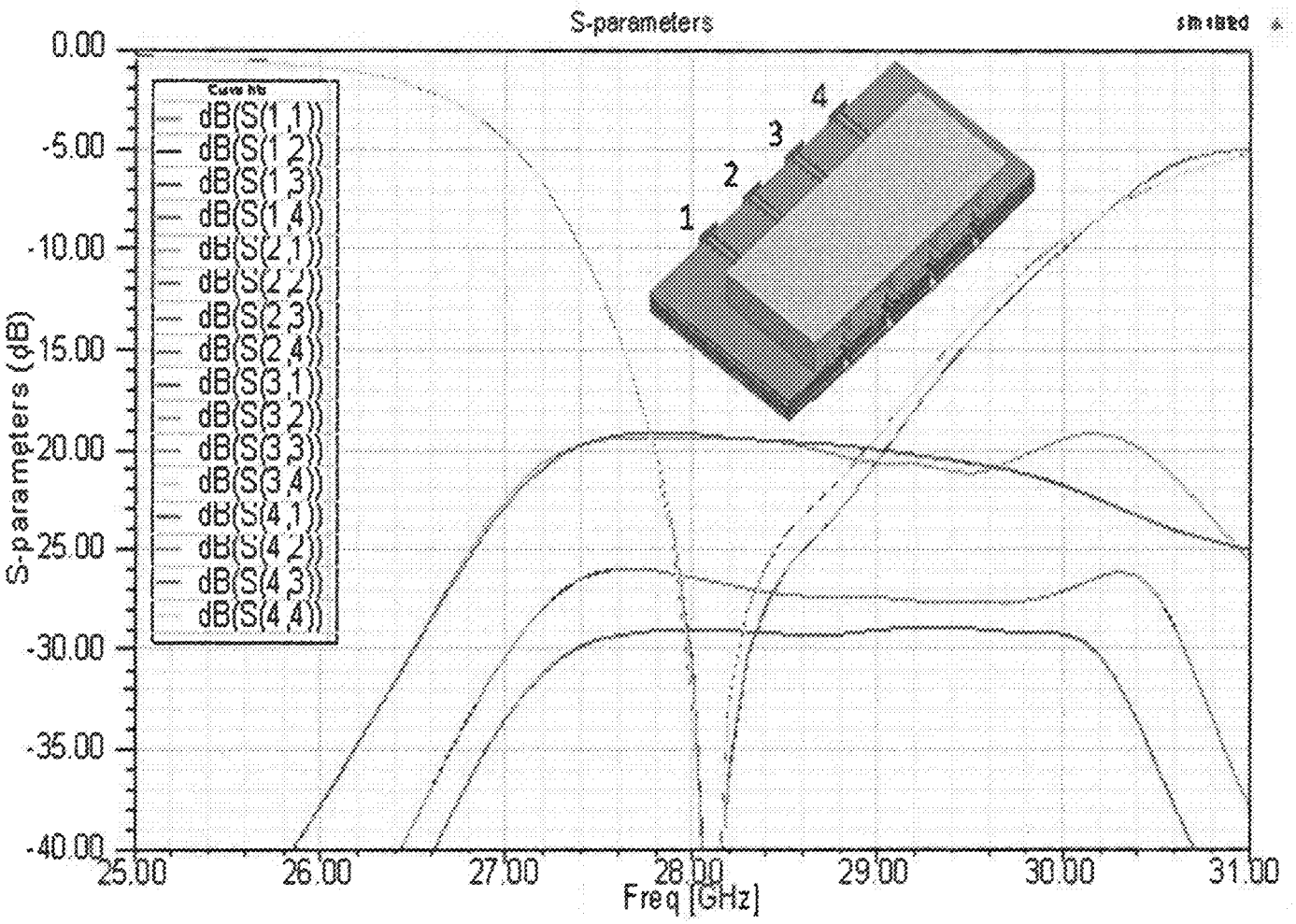
Figure 19A:
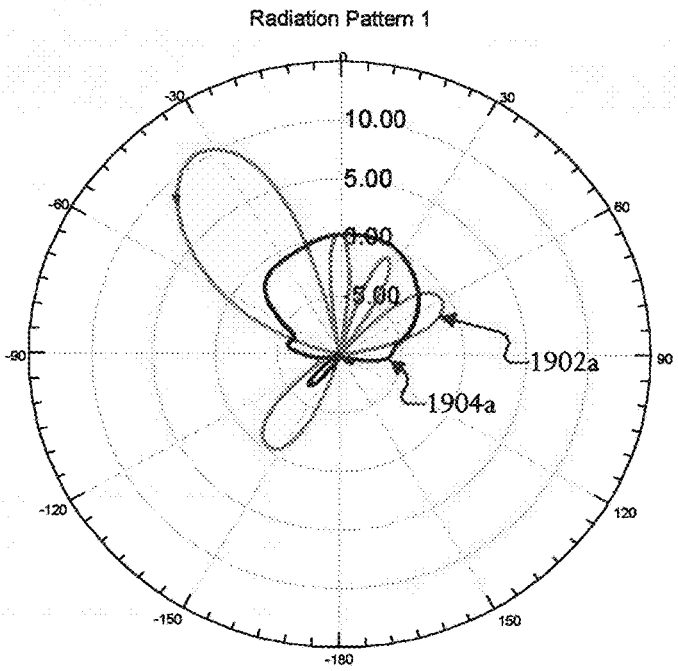
Figure 19B:
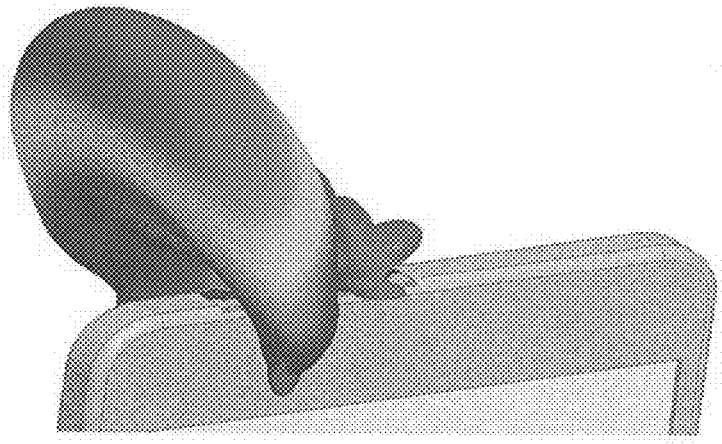
Figure 19C:
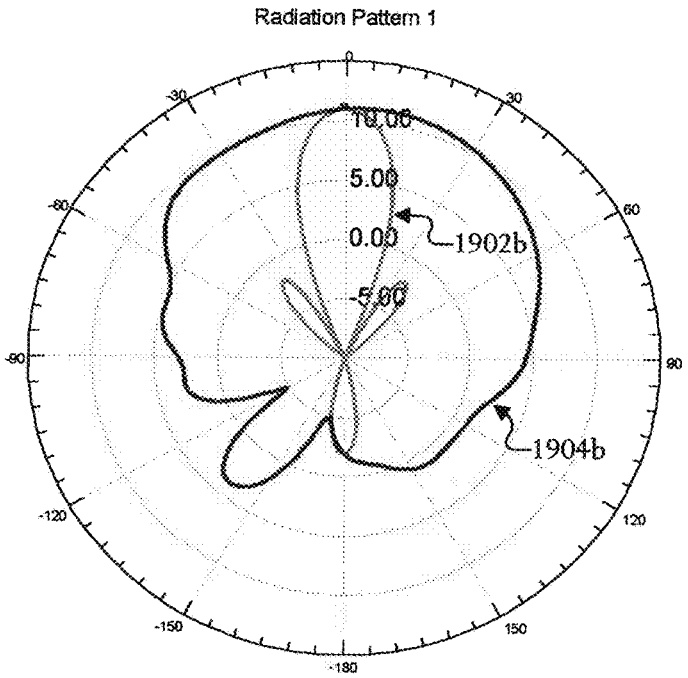
Figure 19D:
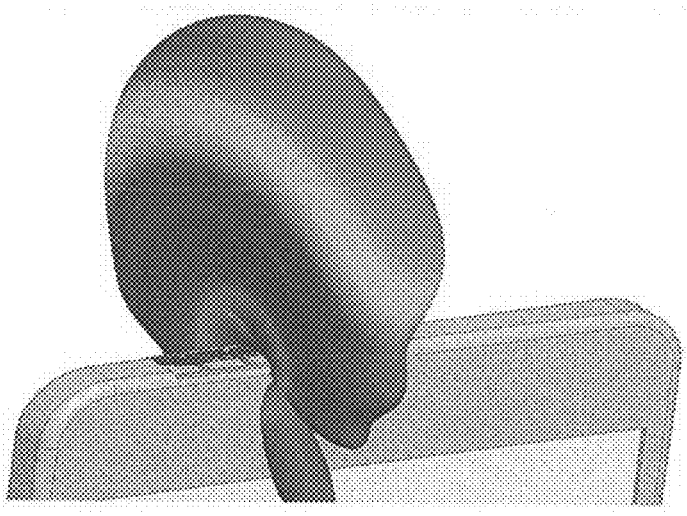

Simulated S-parameters of the antenna array 1600 are shown in FIG. 18. Simulated radiation patterns of the antenna array 1600 are shown in FIGS. 19A through 19F. FIGS. 19A and 19B illustrate the simulated antenna radiation pattern of the antenna array 1600 with beam steering to −35° and with −45° well covered with the 3 dB beamwidth. FIGS. 19C and 19D illustrate the simulated antenna radiation pattern of the antenna array 1600 with beam steering to broadside. FIGS. 19E and 19F illustrate the simulated antenna radiation pattern of the antenna array 1600 with beam steering to +35° and with +45° well covered with the 3 dB beamwidth. In FIGS. 19A, 19C, and 19E, lines 1902*a*-1902*c* denote the realized gains (phi) at 0°, and lines 1904*a*-1904*c* denote the realized gains (theta) at 90°.

As can be seen here, even with an all-metallic case, the antenna array 1600 exhibits excellent scanning coverage from −45° to +45° with good gain covering the top and bottom sides of the smartphone or other device. This approach can therefore provide an upgraded and stylish look for a smartphone or other device. At the same time, this approach can use the cover of the device itself as part of the heat sink for internal device circuits, providing improved thermal dissipation compared to plastic cases.

Figure 20:
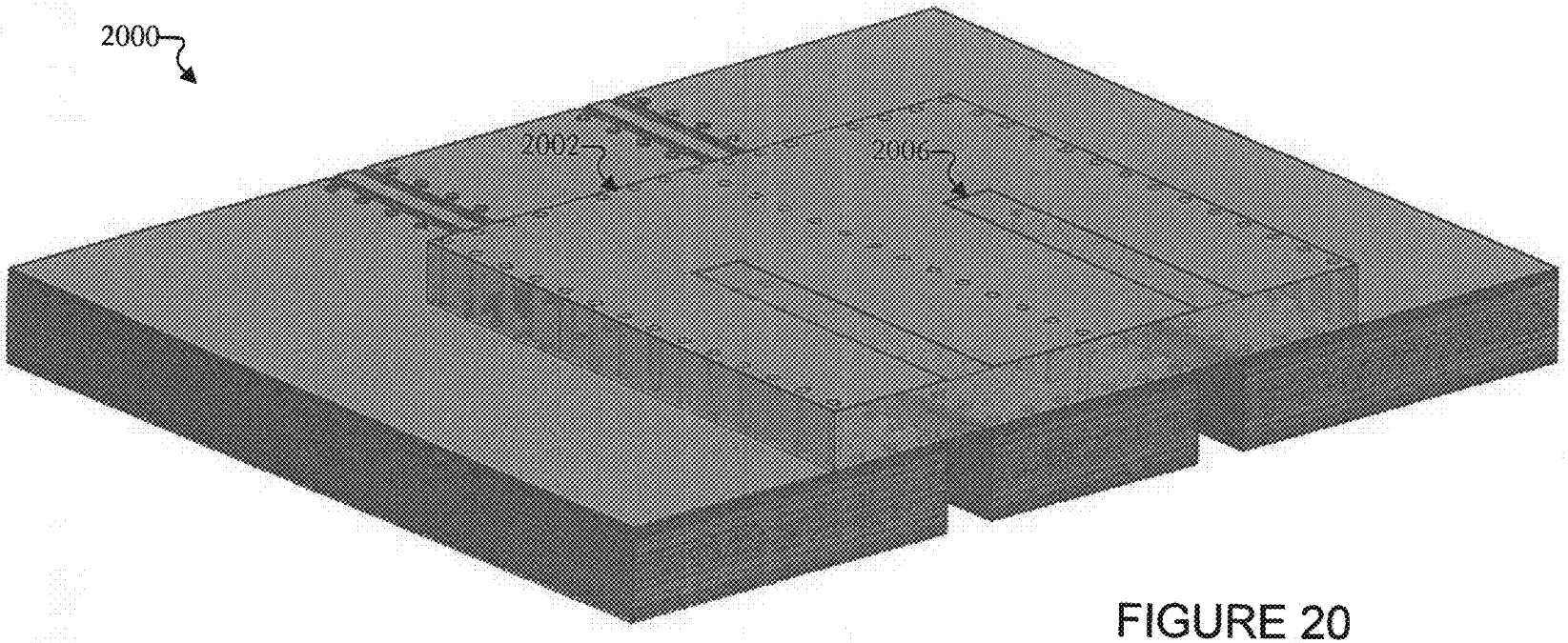
FIG. 20 illustrates yet another example 1D or 2D multi-element antenna array according to this disclosure.

FIG. 20 illustrates yet another example 1D or 2D multi-element antenna array 2000 according to this disclosure. The antenna array 2000 could represent a two-by-one antenna array or a two-by-two antenna array in which at least the top antenna elements are covered by a cap 2002. Unlike previous approaches, the cap 2002 here is formed using a separate PCB, such as a DUROID 5880 high-frequency laminate from ROGERS CORP. A waveguide radiator can be formed in the cap 2002 using a substrate integrated waveguide (SIW). In this case, the radiator is filled with dielectric material, and vias can be formed through the cap 2002. Note that in this approach, slots 2006 can be formed in the cap 2002 entirely through the cap 2002 or by removing top and bottom metal layers of the cap 2002 (while leaving the remaining substrates of the PCB intact). Using a PCB as the cap 2002 can reduce the overall size of the antenna array 2000, although it could have a corresponding reduction in the bandwidth of the antenna.

While FIGS. 4A through 20 illustrate various examples of antenna elements, multi-element antenna arrays, and related details, various changes may be made to FIGS. 4A through 20. For example, the relative sizes, shapes, and dimensions of the components in the antenna elements and the multi-element antenna arrays are for illustration only. Also, the various simulated behaviors of the antenna elements and antenna arrays relate to specific embodiments of the antenna elements and arrays, and other embodiments of the antenna elements and antenna arrays need not behave identically as shown in the plots of simulated behaviors. Further, the antenna elements and antenna arrays could be used in any suitable devices or systems and are not limited to use with UEs having all-metallic cases, and a UE having an all-metallic case could use any of the antenna elements or antenna arrays described above. Moreover, each antenna array described above could be extended in one, two, or three dimensions so as to include any suitable number of antenna elements in any suitable array.

In addition, note that various features shown in one or some of the figures could be used in others of the figures. For instance, a cap implemented using a PCB could be used in any of the antenna elements or antenna arrays described above. As another example, any of the antenna arrays described above could use one or more slabs 1604-1606 over one or more antenna elements or PCB. As yet another example, any of the antenna elements and antenna arrays described above could use at least one cap that extends over one or more power amplifiers. Finally, note that specific dimensions, frequencies, and other numerical values given above represent approximate values and that some deviation from these values can be expected.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. An apparatus comprising:

an antenna element comprising:

a first portion of a multi-layer printed circuit board (PCB), the multi-layer PCB comprising multiple substrates, a top layer of the multi-layer PCB comprising a conductive layer, the first portion of the multi-layer PCB defining a first slot extending from a top layer of the multi-layer PCB through the multiple substrates to a bottom layer of the multi-layer PCB, the first slot extending inward from an exterior lateral edge of the multi-layer PCB toward an interior of the multi-layer PCB; and a cap covering a part of the top layer of the multi-layer PCB, the cap defining a second slot and further defining a space between a portion of the top layer of the multi-layer PCB and the cap, wherein the second slot is aligned with and disposed over the first slot such that the second slot is coextensive with the first slot when viewed along an axis perpendicular to the top layer of the multi-layer PCB;

wherein the cap and the top layer of the multi-layer PCB form a waveguide structure within the space between the cap and the top layer through which wireless signals radiate from the antenna element.

2. The apparatus of claim 1, wherein the antenna element further comprises:

a mode transit cavity within the first portion of the multi-layer PCB; and a feed line coupled to a feed line-to-waveguide transition that is adjacent to the mode transit cavity.

3. The apparatus of claim 2, wherein the feed line-to-waveguide transition tapers from a narrower width at one end to a maximum width at an opposite end.

4. The apparatus of claim 1, wherein:

the antenna element comprises a first antenna element; and the apparatus further comprises at least one additional antenna element, each additional antenna element comprising an additional portion of the multi-layer PCB with an additional first slot and a portion of the cap or an additional cap having an additional second slot.

5. The apparatus of claim 4, wherein:

each antenna element comprises a mode transit cavity within the multi-layer PCB;

different antenna elements are positioned on opposite sides of the multi-layer PCB; and the antenna elements are offset so that the mode transit cavities of the antenna elements are located in different areas of the multi-layer PCB.

6. The apparatus of claim 4, wherein:

the apparatus further comprises multiple power amplifiers, each power amplifier configured to feed one of the antenna elements; and at least one of the caps extends over and thermally contacts one or more of the power amplifiers.

7. The apparatus of claim 4, wherein:

multiple antenna elements are positioned on a single side of the multi-layer PCB;

a first slab covers at least part of the cap; and a second slab covers at least part of an opposite side of the multi-layer PCB.

8. The apparatus of claim 1, wherein the cap comprises a metallic structure.

9. The apparatus of claim 1, wherein the cap comprises a second PCB.

10. A system comprising:

an antenna;

a transceiver configured to down-convert incoming signals received from the antenna and to up-convert outgoing signals to be transmitted by the antenna;

receive processing circuitry configured to process the down-converted incoming signals; and transmit processing circuitry configured to generate the outgoing signals;

wherein the antenna comprises an antenna element, the antenna element comprising:

a first portion of-a multi-layer printed circuit board (PCB), the multi-layer PCB comprising multiple substrates, a top layer of the multi-layer PCB comprising a conductive layer, the first portion of the multi-layer PCB defining a first slot extending from a top layer of the multi-layer PCB through the multiple substrates to a bottom layer of the multi-layer PCB, the first slot extending inward from an exterior lateral edge of the multi-layer PCB toward an interior of the multi-layer PCB; and a cap covering a part of the top layer of the multi-layer PCB, the cap defining a second slot and further defining a space between a portion of the top layer of the multi-layer PCB and the cap, wherein the second slot is aligned with and disposed over the first slot such that the second slot is coextensive with the first slot when viewed along an axis perpendicular to the top layer of the multi-layer PCB;

wherein the cap and the top layer of the multi-layer PCB form a waveguide structure within the space between the cap and the top layer through which wireless signals radiate from the antenna element.

11. The system of claim 10, wherein the antenna element further comprises:

a mode transit cavity within the first portion of the multi-layer PCB; and a feed line coupled to a feed line-to-waveguide transition that is adjacent to the mode transit cavity.

12. The system of claim 11, wherein the feed line-to-waveguide transition tapers from a narrower width at one end to a maximum width at an opposite end.

13. The system of claim 10, wherein:

the antenna element comprises a first antenna element; and the antenna further comprises at least one additional antenna element, each additional antenna element comprising an additional portion of the multi-layer PCB with an additional first slot and a portion of the cap or an additional cap having an additional second slot.

14. The system of claim 13, wherein:

each antenna element comprises a mode transit cavity within the multi-layer PCB;

different antenna elements are positioned on opposite sides of the multi-layer PCB; and the antenna elements are offset so that the mode transit cavities of the antenna elements are located in different areas of the multi-layer PCB.

15. The system of claim 13, wherein:

the system further comprises multiple power amplifiers, each power amplifier configured to feed one of the antenna elements; and at least one of the caps extends over and thermally contacts one or more of the power amplifiers.

16. The system of claim 13, wherein:

multiple antenna elements are positioned on a single side of the multi-layer PCB;

a first slab covers at least part of the cap; and a second slab covers at least part of an opposite side of the multi-layer PCB.

17. The system of claim 10, wherein the antenna, transceiver, receive processing circuitry, and transmit processing circuitry form part of a user equipment.

18. The system of claim 10, wherein multiple antennas, multiple transceivers, the receive processing circuitry, and the transmit processing circuitry form part of an eNodeB.

19. A method comprising:

feeding signals to an antenna element, the antenna element comprising:

a first portion of-a multi-layer printed circuit board (PCB), the multi-layer PCB comprising multiple substrates, a top layer of the multi-layer PCB comprising a conductive layer, the first portion of the multi-layer PCB defining a first slot extending from a top layer of the multi-layer PCB through the multiple substrates to a bottom layer of the multi-layer PCB, the first slot extending inward from an exterior lateral edge of the multi-layer PCB toward an interior of the multi-layer PCB; and a cap covering a part of the top layer of the multi-layer PCB, the cap defining a second slot and further defining a space between a portion of the top layer of the multi-layer PCB and the cap, wherein the second slot is aligned with and disposed over the first slot such that the second slot is coextensive with the first slot when viewed along an axis perpendicular to the top layer of the multi-layer PCB; and radiating wireless signals from the antenna element through a waveguide structure formed within the space between the cap and the top layer of the multi-layer PCB.

20. The method of claim 19, wherein:

the antenna element and at least one additional antenna element are positioned along one edge of the multi-layer PCB, each additional antenna element comprising an additional portion of the multi-layer PCB with an additional first slot and a portion of the cap or an additional cap having an additional second slot; and the antenna elements are surrounded on four sides by a metallic case of a device that includes the antenna elements.

* * * * *